US009233549B2

(12) United States Patent
Nakano et al.

(10) Patent No.: US 9,233,549 B2
(45) Date of Patent: Jan. 12, 2016

(54) RECORDING APPARATUS

(71) Applicant: SEIKO EPSON CORPORATION, Tokyo (JP)

(72) Inventors: Yosuke Nakano, Shiojiri (JP); Satoshi Shimizu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/963,862

(22) Filed: Aug. 9, 2013

(65) Prior Publication Data

US 2014/0043410 A1 Feb. 13, 2014

(30) Foreign Application Priority Data

Aug. 10, 2012 (JP) ..... 2012-178518

(51) Int. Cl.

| | |
|---|---|
| ***B41J 2/17*** | (2006.01) |
| ***B41J 2/175*** | (2006.01) |
| ***B41J 29/02*** | (2006.01) |
| ***B41J 29/13*** | (2006.01) |

(52) U.S. Cl.

CPC ..... *B41J 2/17553* (2013.01); *B41J 29/02* (2013.01); *B41J 29/13* (2013.01)

(58) Field of Classification Search

CPC ..... B41J 2/175
USPC ..... 347/84–86, 108
See application file for complete search history.

(56) References Cited

U.S. PATENT DOCUMENTS

| | | | | |
|---|---|---|---|---|
| 2006/0284945 | A1* | 12/2006 | Kobayashi et al. | 347/85 |
| 2007/0229565 | A1* | 10/2007 | Imai | 347/16 |
| 2009/0085989 | A1* | 4/2009 | Takata | 347/85 |
| 2010/0124449 | A1* | 5/2010 | Asada et al. | 399/393 |
| 2011/0018947 | A1* | 1/2011 | Kobayashi | 347/85 |

FOREIGN PATENT DOCUMENTS

| | | |
|---|---|---|
| JP | 2008-238787 | 10/2008 |
| JP | 2012-109703 | 6/2012 |

* cited by examiner

*Primary Examiner* — Stephen Meier
*Assistant Examiner* — Sharon A Polk
(74) *Attorney, Agent, or Firm* — Workman Nydegger

(57) ABSTRACT

A recording apparatus includes a recording unit that has a head unit provided with a recording head in a movable manner in a scanning direction of the recording head, and a scanner unit that is provided on the upper side of the recording unit and is capable of opening and closing the upper side of the recording unit; the recording unit includes a flexible ink tube that guides ink which is sent from a ink holding unit for holding the ink to the head unit, a gap formation member configured to form between the recording unit and the scanner unit a gap through which the ink tube passes and the size of which is sufficiently large so as not to block an ink flow path in the ink tube, and a medium reception tray having a relief portion that is formed on the upstream side in a medium discharge direction so as to avoid a feeding unit.

9 Claims, 16 Drawing Sheets

RECORDING APPARATUS

BACKGROUND

1. Technical Field

The present invention relates to recording apparatuses that include a recording unit and an opening/closing member which is disposed on an upper side of the recording unit and is capable of opening and closing the upper side of the recording unit.

In this application, recording apparatuses include various kinds of apparatuses such as ink jet printers, copy machines, fax machines, and so on.

2. Related Art

Ink jet printers are an example of recording apparatuses. Of the ink jet printers, there is provided such a printer that has a scanning function in addition to a printing function (JP-A-2012-109703). An ink jet printer having the stated scanning function is called a complex machine. This complex machine is capable of reading documents and recording on paper by itself, which enhances convenience of a user and save the installation space as a whole.

In this ink jet printer, a scanner unit is provided on a printer unit, which is a main apparatus body, in a freely rotatable manner with respect to the printer unit about a rotational shaft as a fulcrum disposed at a rear end portion of the scanner unit.

The scanner unit includes an upper frame serving as a housing, an image reading section accommodated in the upper frame, an upper lid that is supported in a freely rotatable manner on the upper frame, and a document placement plate that faces the upper lid when the upper lid is closed. In the scanner unit, a document is placed on the document placement plate and the placed document can be read by the image reading section that is moved along a guide shaft provided in the scanner unit.

Note that an ink jet printer including the above scanner unit has a structure in which the scanner unit is provided on the printer unit. This structure has caused an increase in height of a recording apparatus to make the recording apparatus larger in size.

Further, in a recording apparatus such as an ink jet printer including an ink cartridge, the amount of ink held in the ink cartridge which is detachably disposed in the main apparatus body is limited. Accordingly, in this ink jet printer, there is a risk that the number of operations to exchange the ink cartridge will be increased if recording is performed on a large amount of target recording media.

Therefore, among the recording apparatuses equipped with carriages, there is such a recording apparatus that includes an ink supply system in which an ink tube connected with the carriage side is also connected with a large-capacity ink tank disposed outside the main apparatus body so as to supply ink from the large-capacity ink tank to the carriage side, thereby making it possible to perform recording on a large amount of target recording media (JP-A-2008-238787).

In a recording apparatus including such ink supply system, it is necessary to extend an ink tube connected with a carriage from a printer housing to the outside of the stated housing and to connect the extended ink tube with a large-capacity ink tank. Accordingly, it has been necessary to form a space through which the ink tube passes in the housing so as to extend the ink tube from the housing to the outside of the housing. This increases the height of the housing due to the space being formed, and the recording apparatus is likely to become larger in size.

SUMMARY

An advantage of some aspects of the invention is to provide a recording apparatus that has a space formed therein through which an ink tube passes supplying ink from an ink holding unit to a recording head, and that is also capable of suppressing the increase in size of the recording apparatus.

A recording apparatus according to an aspect of the invention includes: a recording unit that has a head unit provided with a recording head configured to eject ink onto a medium at a position inside a main apparatus body in a movable manner in a scanning direction of the recording head; and an opening/closing member that is provided on an upper side of the recording unit and is capable of opening and closing the upper side of the recording unit. Further in the recording apparatus, the recording unit includes: a flexible ink tube that guides ink which is sent from an ink holding unit for holding the ink to the above head unit; a gap formation member configured to form a gap between the recording unit and the opening/closing member through which the ink tube passes, and the size of which is sufficiently large so as not to block at least an ink flow path in the ink tube; a feeding unit configured to feed out a medium from a medium holding unit for holding the medium; and a medium reception tray that is so provided as to be displaced between a projecting position projected from the recording unit and an accommodation position at which the medium reception tray is held in the recording unit, and that receives a medium to be discharged. Furthermore, the medium holding unit includes a medium holding tray that is disposed under the medium reception tray independently of the medium reception tray in a detachable manner with respect to the recording unit; the medium reception tray has a relief portion that is formed on the upstream side in a medium discharge direction so as to avoid the feeding unit, and the feeding unit is located inside the relief portion in the case of the medium reception tray being at the accommodation position.

According to this aspect, it is possible to form a gap between the recording unit and the opening/closing member through which the ink tubes passes, and the size of which is sufficiently large so as not to block at least an ink flow path in the ink tube. In addition, because a relief portion for avoiding the feeding unit is formed in the medium reception tray, it is unnecessary to superpose the feeding unit and the medium reception tray on each other in a height direction of the apparatus. This makes it possible to overlap the feeding unit and the medium reception tray with respect to the height direction and suppress the increase in dimension of the apparatus in the height direction.

In the aspect of the invention, it is preferable that the relief portion be formed as a cutout surrounding the feeding unit.

In the aspect of the invention, it is preferable that the feeding unit and the cutout be superposed on each other in the height direction while the medium reception tray being at the accommodation position.

In the aspect of the invention, it is preferable that a feed reference position of the feeding unit be set at the center in a width direction of the medium and that the cutout be formed at the center in the width direction of the medium.

In the aspect of the invention, it is preferable that the cutout be formed so that the width of the cutout becomes narrower toward the downstream side in a direction in which the medium is discharged.

In the aspect of the invention, it is preferable that the medium holding unit include a lower stage tray and an upper stage tray which is provided above the lower stage tray and is independent of the lower stage tray, the lower and upper stage trays serving as the above medium holding tray, and that the feeding unit, in the case where any one of the upper stage tray and the lower stage tray is detached from the recording unit, be capable of accessing the other tray.

According to the above, in the configuration including the lower stage tray and the upper stage tray, even if any one of these trays is detached, the other tray can be accessed; therefore, the medium can be fed regardless of a mounted state of the medium holding tray.

In the aspect of the invention, it is preferable that the feeding unit include a single feed roller, and the single feed roller be capable of accessing both the upper stage tray and the lower stage tray.

According to the above, since the single feed roller is capable of accessing both the upper stage tray and the lower stage tray, the feeding unit can be built in a simplified structure and at low costs.

In the aspect of the invention, it is preferable that the above-mentioned opening/closing member be a scanner unit.

In the recording apparatus according to the aspect of the invention, it is preferable that the scanner unit include a projection sticking out from a bottom surface of the scanner unit on which a guide unit to guide in the scanning direction a reading unit that scans along the movement direction of the head unit is disposed, that the head unit, the projection, the rotational shaft of the scanner unit be disposed in that order from the recording unit front side toward the depth side in a depth direction of the recording unit, and that the above ink tube be connected with both the head unit and the ink holding unit without intersecting with the projection in the depth direction of the recording unit.

According to the above, the ink tube is connected with both the head unit and the ink holding unit without intersecting with the projection of the scanner unit in the depth direction of the recording unit. Therefore, it is possible to avoid a positional interference between the projection of the scanner unit and the ink tube, whereby a risk that the apparatus becomes larger in size as a whole in the height direction is reduced.

In the recording apparatus according to the aspect of the invention, it is preferable that a housing which has an opening portion to expose at least part of the upper side of a movement region of the head unit be included, and that the gap formation member be disposed in an upper surface of the housing on a free end side of the scanner unit which is located on the opposite side to the rotational shaft side of the scanner unit in the depth direction of the recording unit.

According to the above, because the gap formation member is disposed on the free end side of the scanner unit, it is possible to form a gap through which the ink tube passes and the size of which is sufficiently large so as not to block the ink flow path in the ink tube, by raising the scanner unit with respect to the recording unit in accordance with the height of the gap formation member without the scanner unit being fully opened with respect to the recording unit. This makes it possible to set the amount of displacement in the apparatus height direction of the scanner unit smaller, whereby a risk that the apparatus becomes larger in size as a whole in the height direction can be reduced.

In the recording apparatus according to the aspect of the invention, it is preferable that the gap formation member be disposed at the center of the housing in the scanning direction.

According to the above, providing the gap formation member at the center of the housing makes it possible to form the gap with a single member. Therefore, the gap can be formed in a simplified structure, whereby the costs can be lowered.

In the recording apparatus according to the aspect of the invention, it is preferable that the gap formation members be provided at both sides of the housing in the scanning direction.

According to the above, since the gap formation members are provided at both the sides of the housing, the free end side of the scanner unit can be supported by two points. This makes it possible to reduce a risk that the flow path of the ink tube is blocked by the scanner unit being inclined along the scanning direction by an external force.

In the recording apparatus according to the aspect of the invention, it is preferable that the recording apparatus include a front surface panel which is disposed on a front surface of the housing and whose top portion is higher in position than the upper surface of the housing, and that the ink tube be extended to a side of the housing while passing through a space between the gap formation member and the front surface panel. According to this aspect, the front surface panel can guide the ink tube to the side of the housing.

In the recording apparatus according to the aspect of the invention, it is preferable that the gap formation member be provided with at least one through-hole, and that the ink tube be inserted through the through-hole.

According to the above, since the ink tube is inserted through the through-hole formed in the gap formation member, it is possible to reduce a risk that the flow path of the ink tube is blocked.

In the recording apparatus according to the aspect of the invention, it is preferable that at least part of the ink holding unit be disposed outside the main apparatus body.

According to the above, the ink holding unit is provided outside the main apparatus body. This makes it possible to largely increase the capacity of the ink holding unit, perform recording on a large amount of media, and reduce the number of operations to exchange ink cartridges, whereby the convenience of a user can be enhanced.

In the aspect of the invention, it is preferable that the ink holding unit which is disposed outside the main apparatus body be arranged at a side of the recording unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
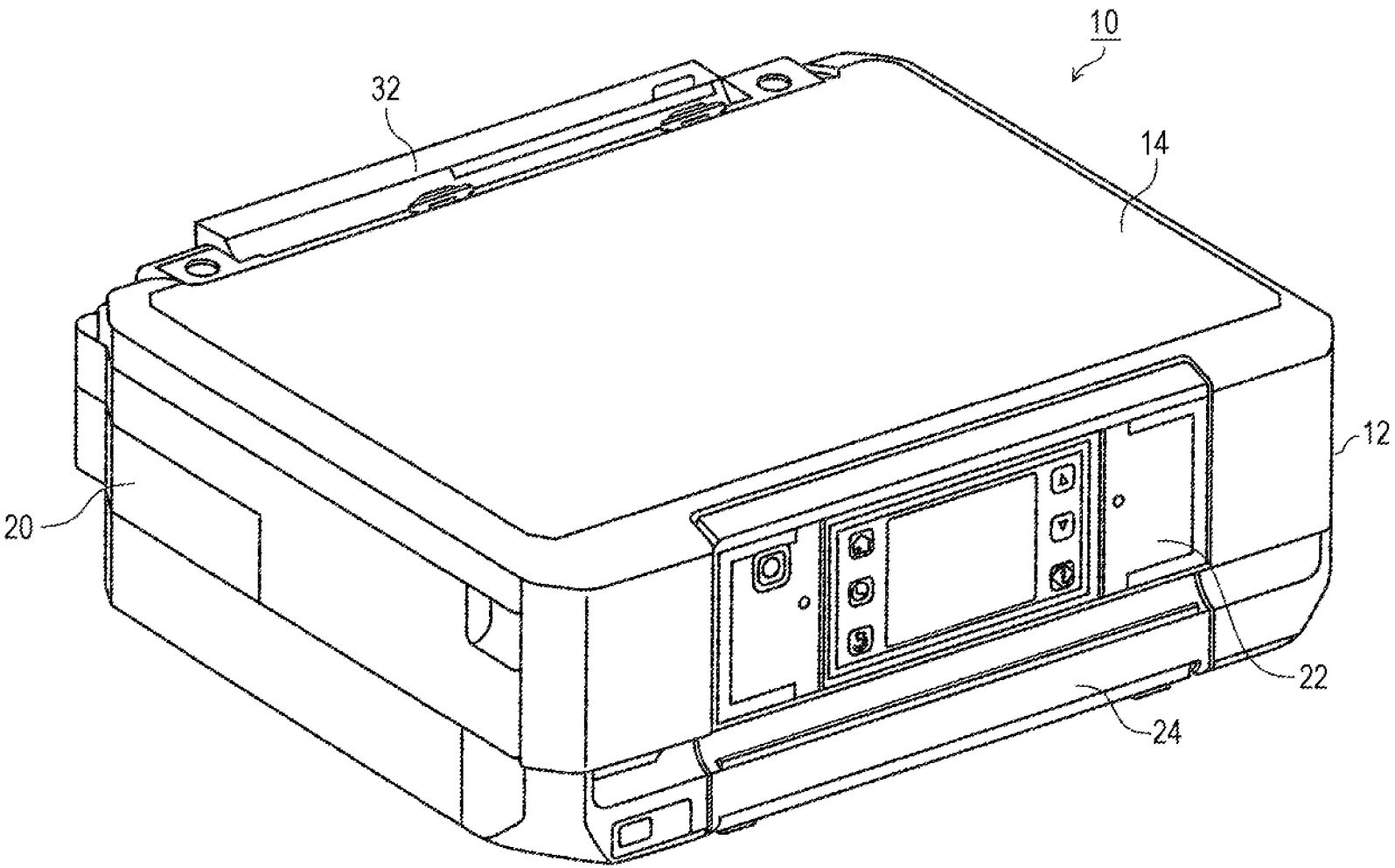
FIG. 1 is an external perspective view of a printer according to the invention.

Hereinafter, embodiments of the invention will be described with reference to the drawings. Note that in the examples described below, same configurations are given the same reference numerals, and explanations thereof will be made only in an example in which the stated configurations first appear and will be omitted in the subsequent examples.

Figure 2:
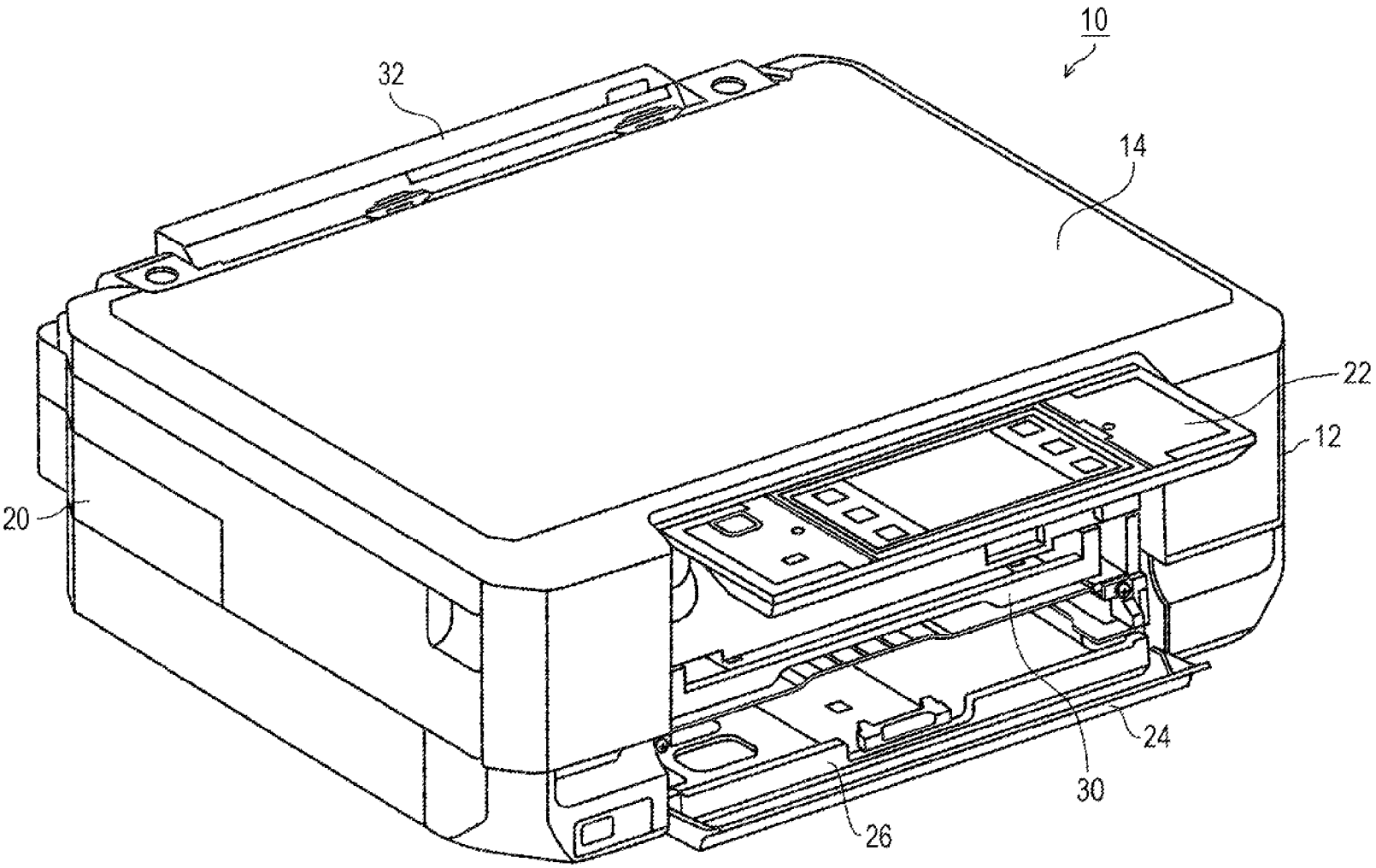
FIG. 2 is another external perspective view of the printer according to the invention.
Figure 3:
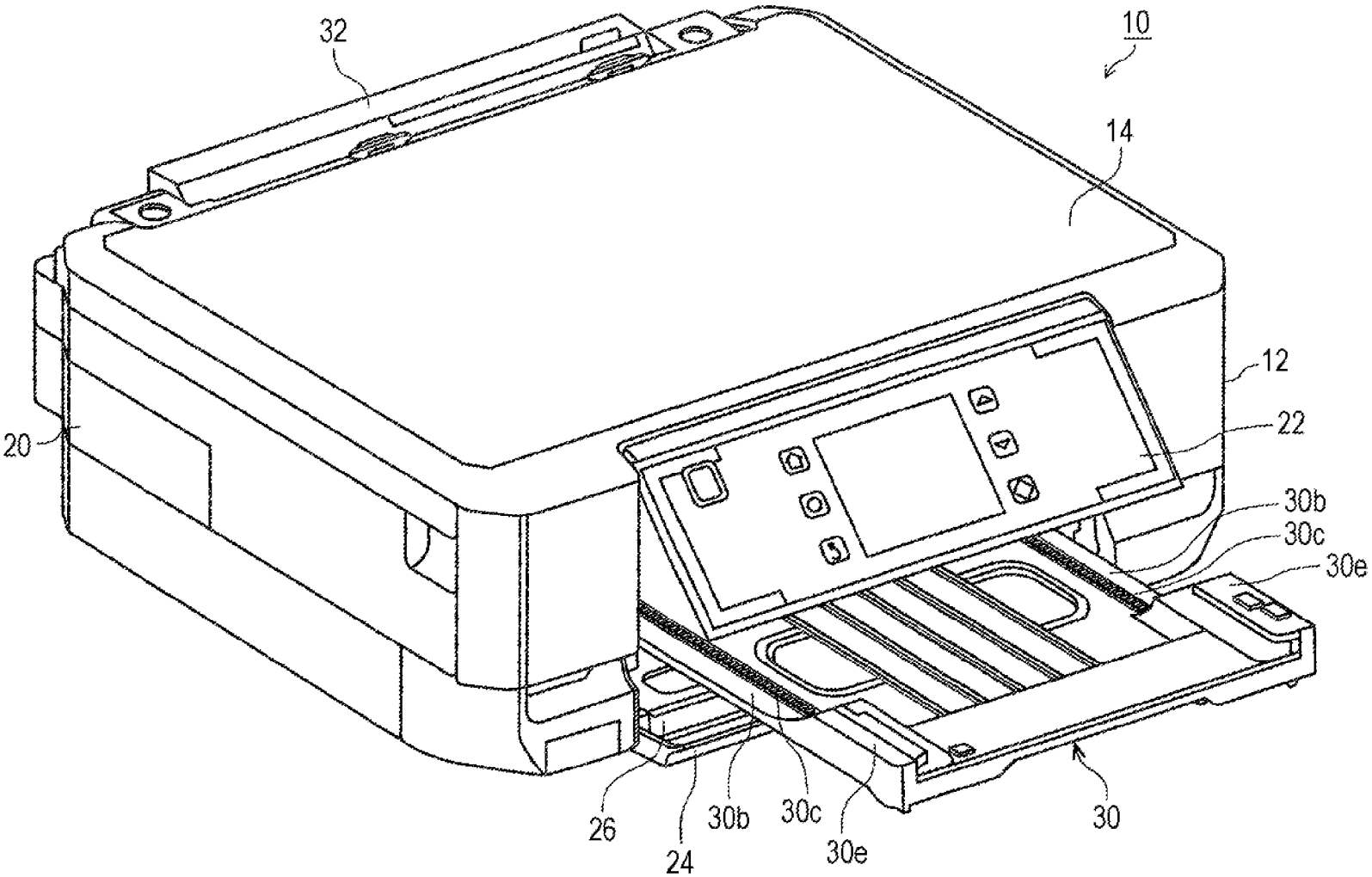
FIG. 3 is still another external perspective view of the printer according to the invention.
Figure 4:
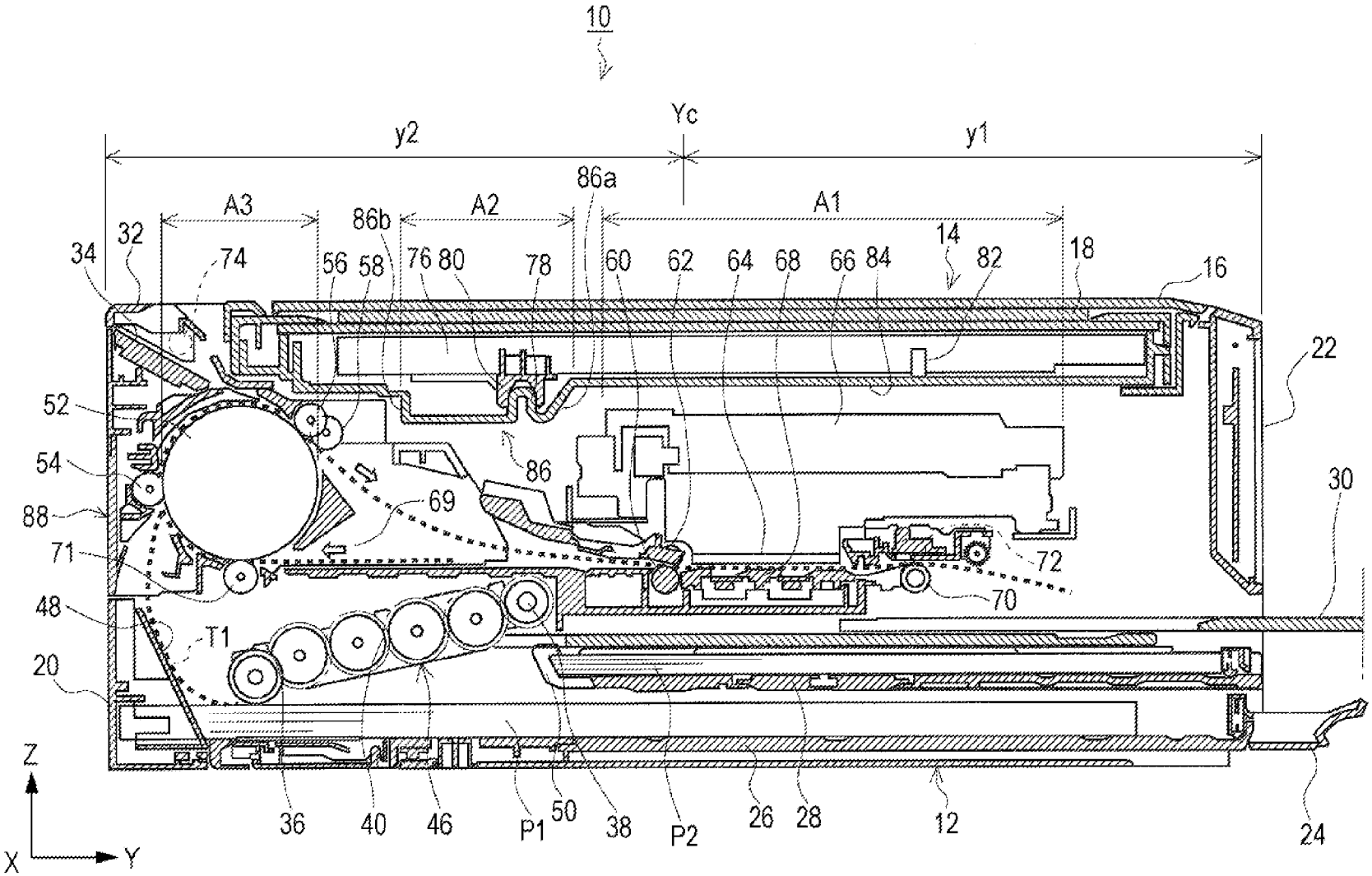
FIG. 4 is a cross-sectional side view illustrating a paper transport path of paper held in a lower stage tray of the printer according to the invention.
Figure 5:
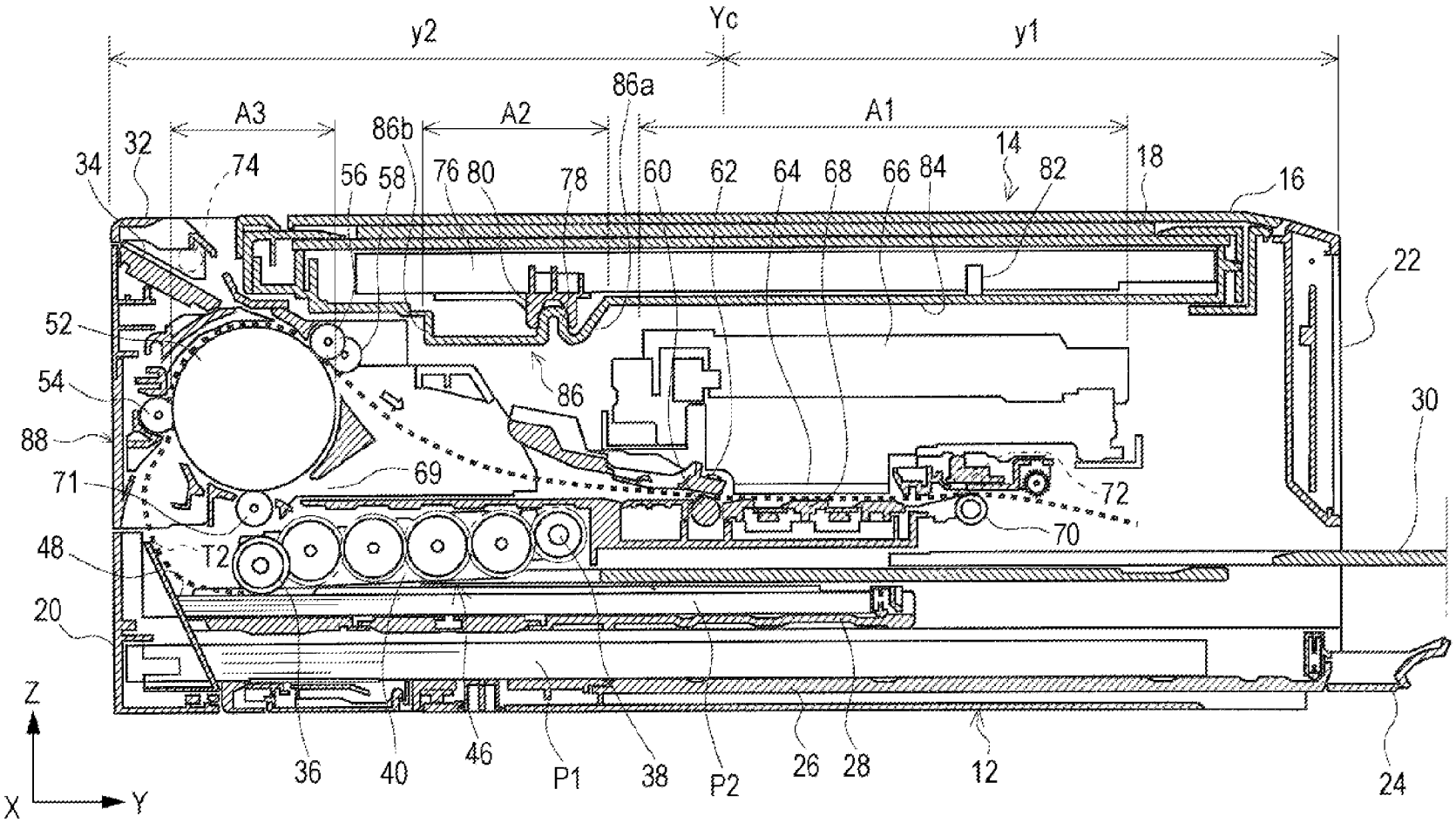
FIG. 5 is a cross-sectional side view illustrating a paper transport path of paper held in an upper stage tray of the printer according to the invention.
Figure 6:
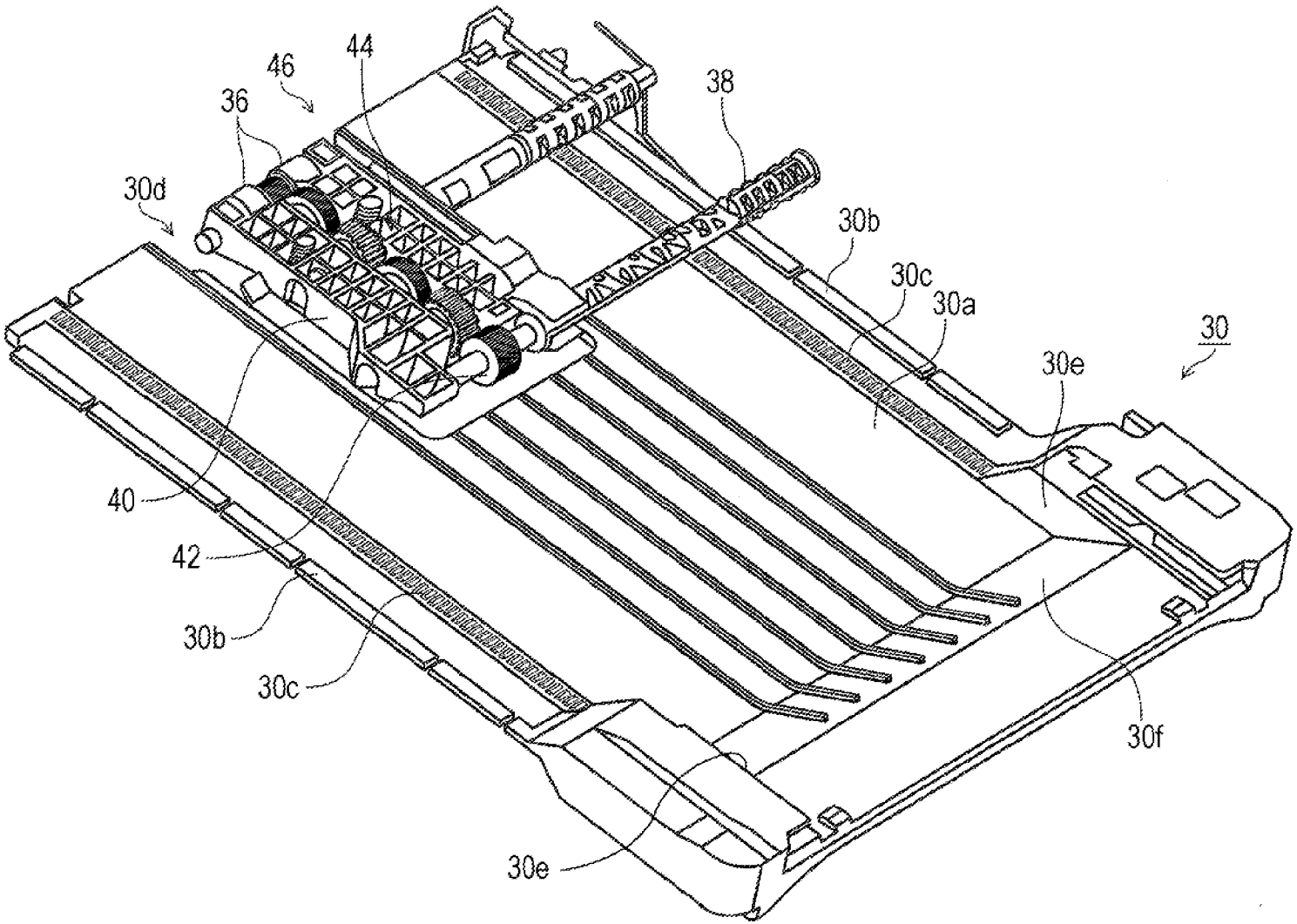
FIG. 6 is a perspective view illustrating a positional relationship between a feeding unit and a medium reception tray.
Figure 7:
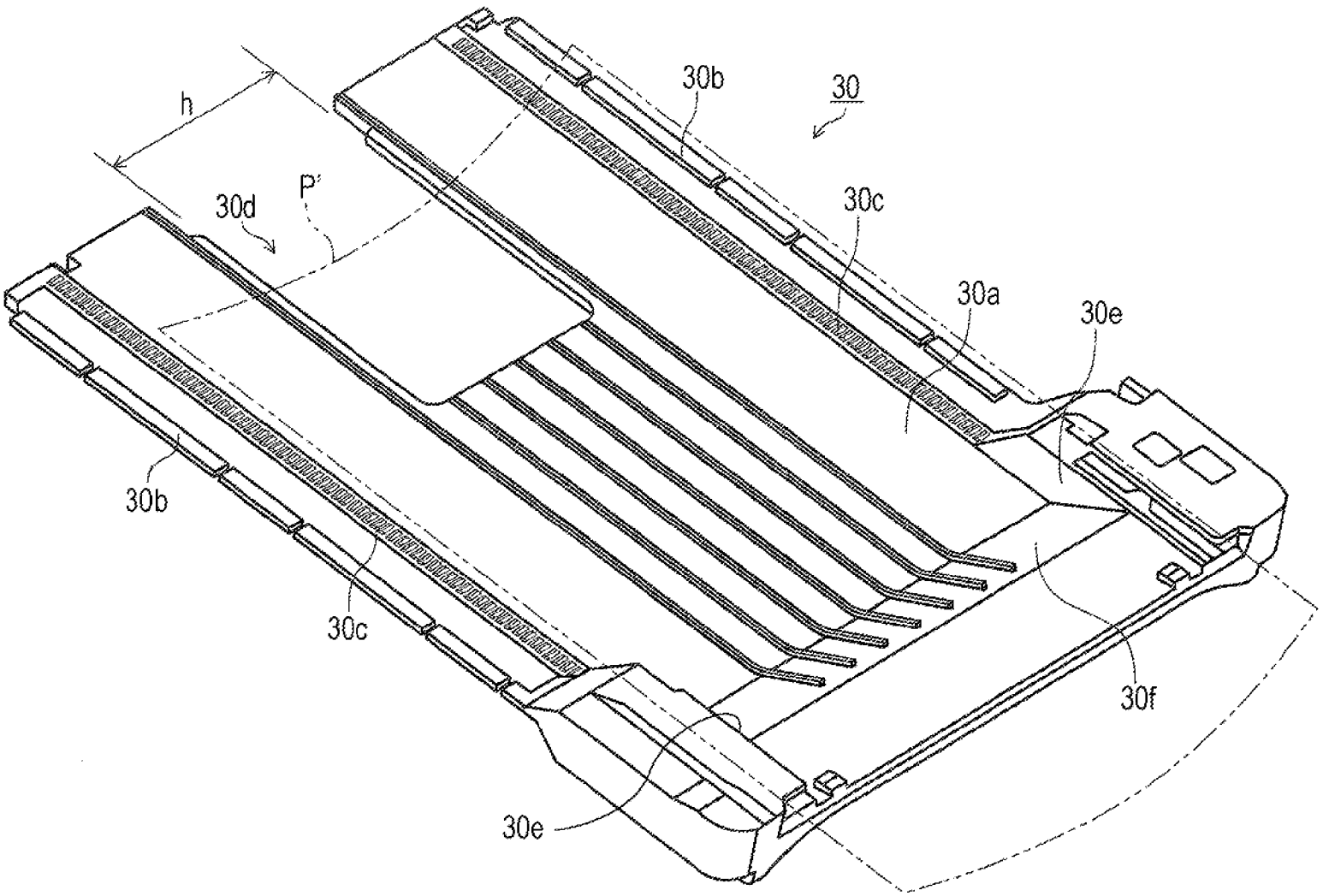
FIG. 7 is a perspective view of the medium reception tray.
Figure 8:
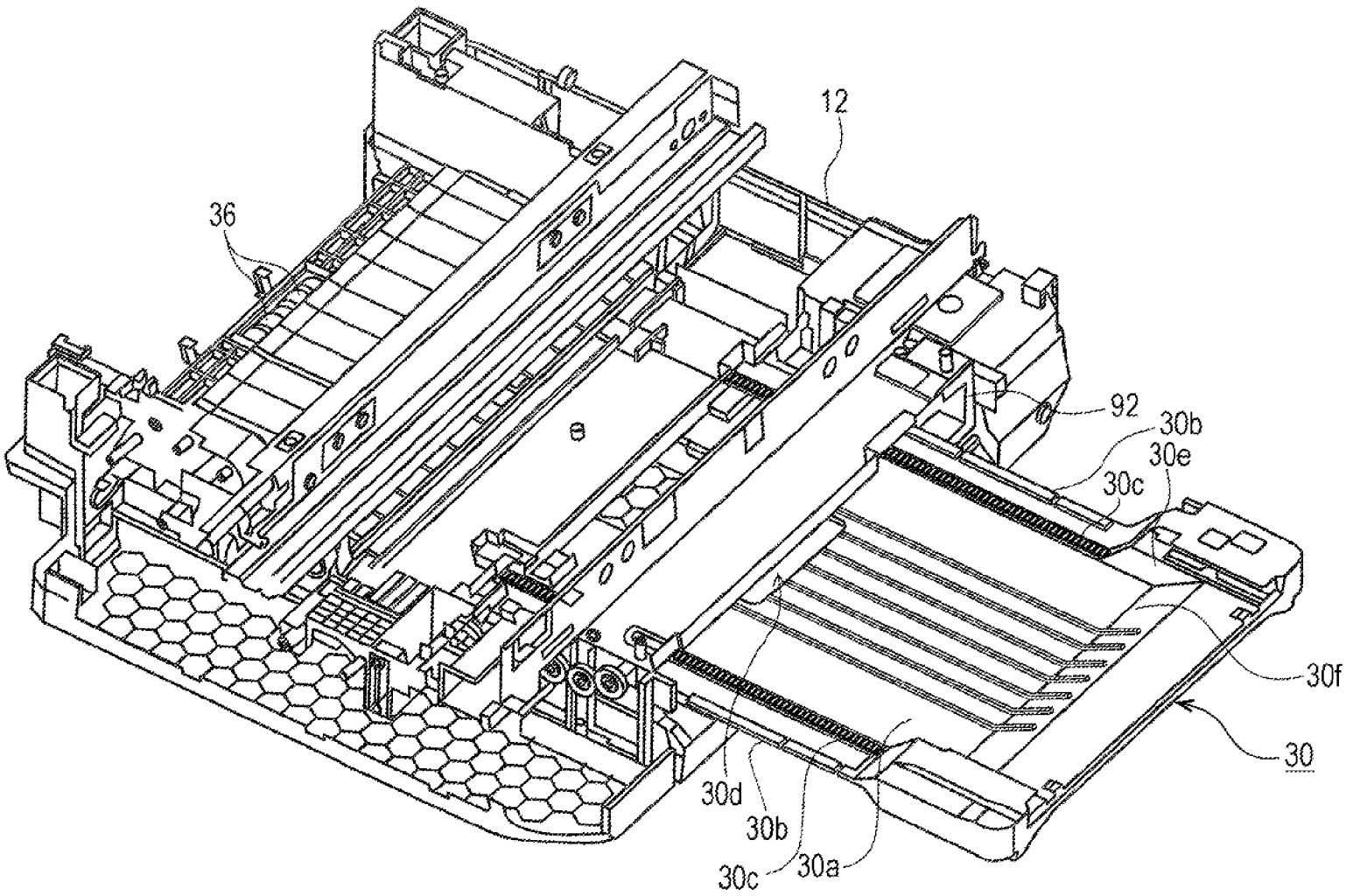
FIG. 8 is a perspective view illustrating a state in which the medium reception tray is projected from a recording unit.
Figure 9:
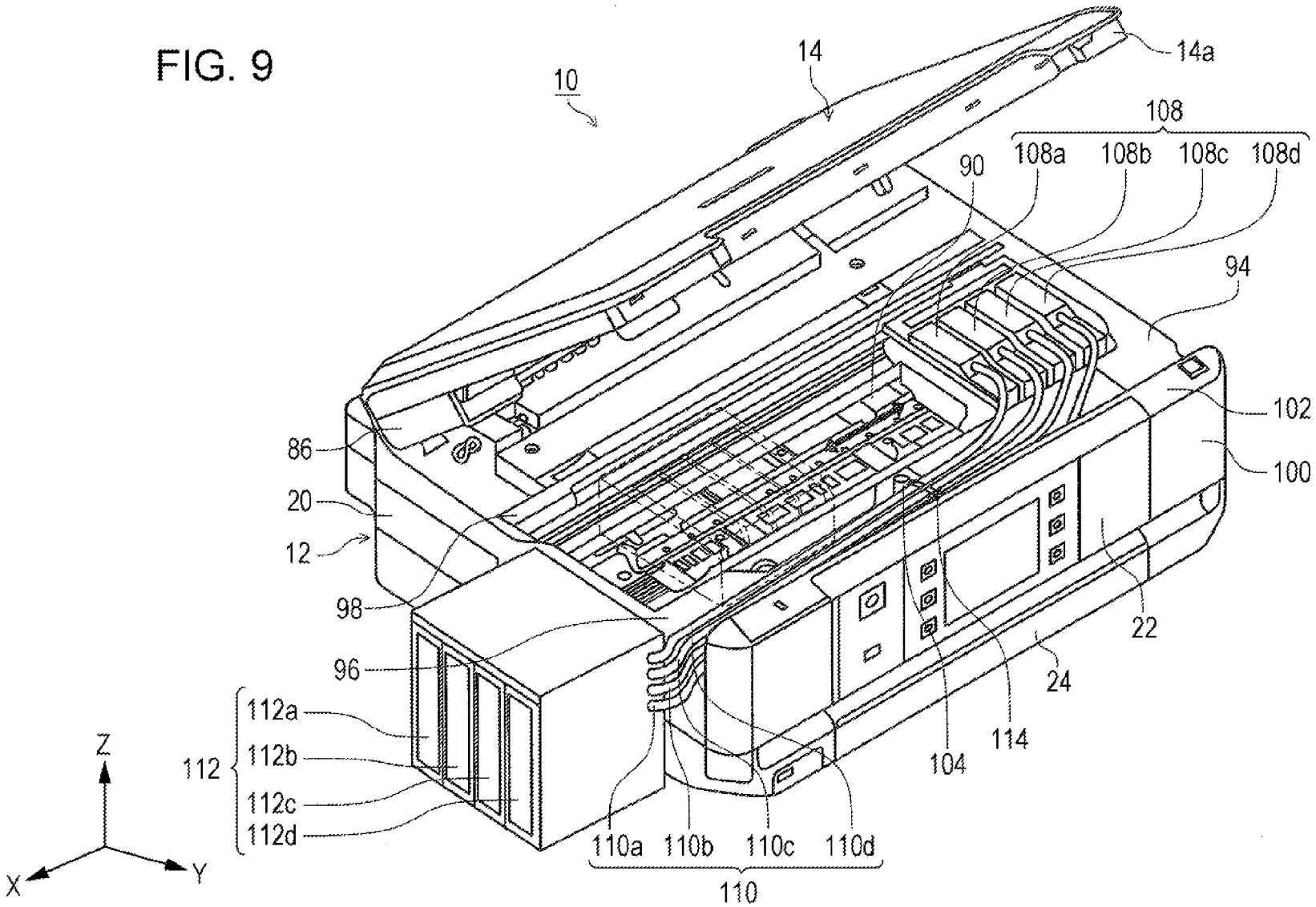
FIG. 9 is an external perspective view illustrating a state in which a scanner unit is opened according to a first example.
Figure 10:
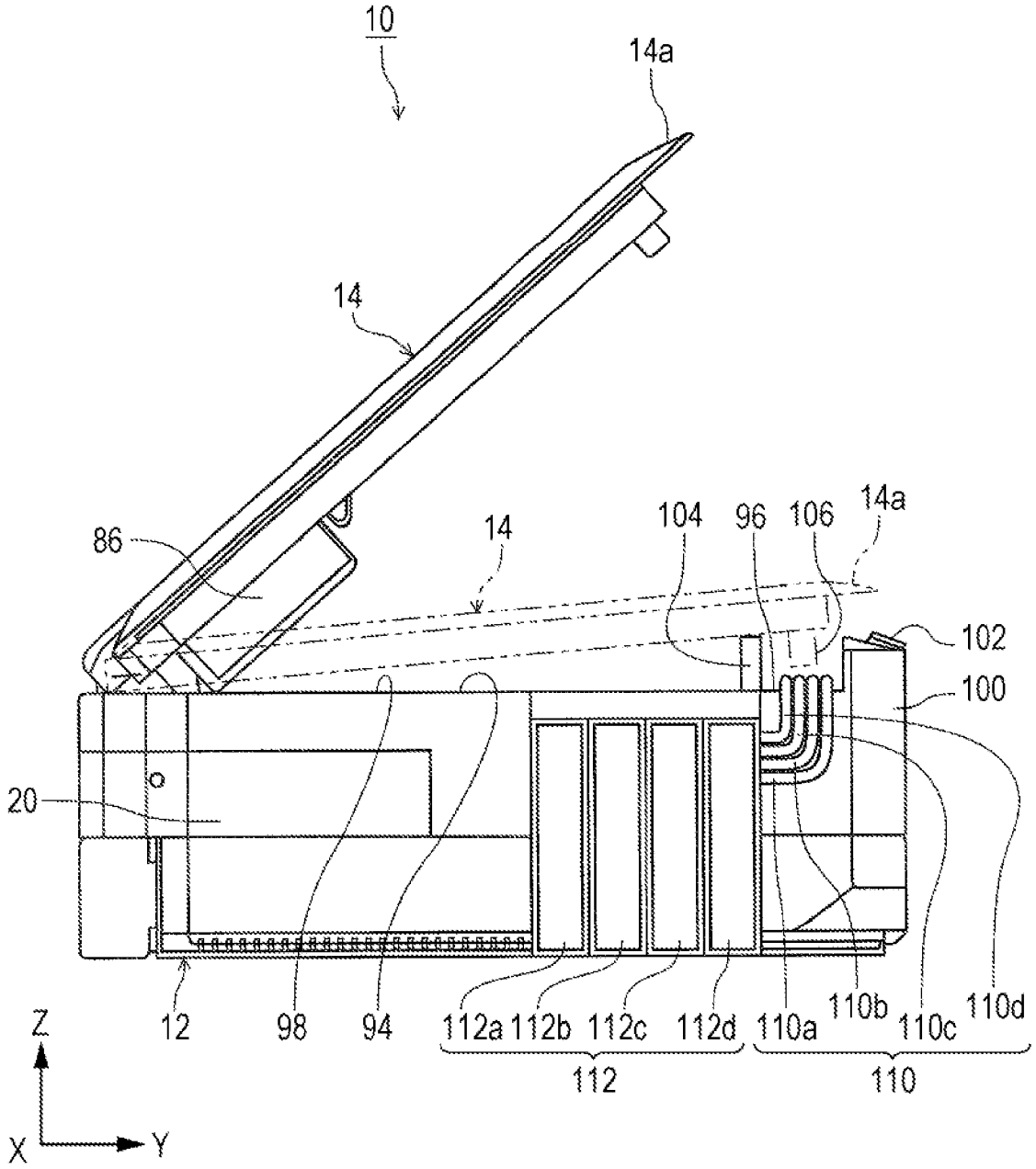
FIG. 10 is a side view illustrating a state in which the scanner unit is opened according to the first example.

FIGS. 1, 2 and 3 are external perspective views of an ink jet printer (hereinafter, called a "printer") 10 as an embodiment of a "recording apparatus" according to the invention; FIG. 4 is a cross-sectional side view illustrating a paper transport path of paper held in a lower stage tray of the printer according to the invention; FIG. 5 is a cross-sectional side view illustrating a paper transport path of paper held in an upper stage tray of the printer according to the invention; FIG. 6 is a perspective view illustrating a positional relationship between a feeding unit and a medium reception tray; FIG. 7 is a perspective view of the medium reception tray; FIG. 8 is a perspective view illustrating a state in which the medium reception tray is projected from a recording unit; FIG. 9 is an external perspective view illustrating a state in which a scanner unit is opened according to a first example; and FIG. 10 is a side view illustrating a state in which the scanner unit is opened according to the first example.

Figure 11:
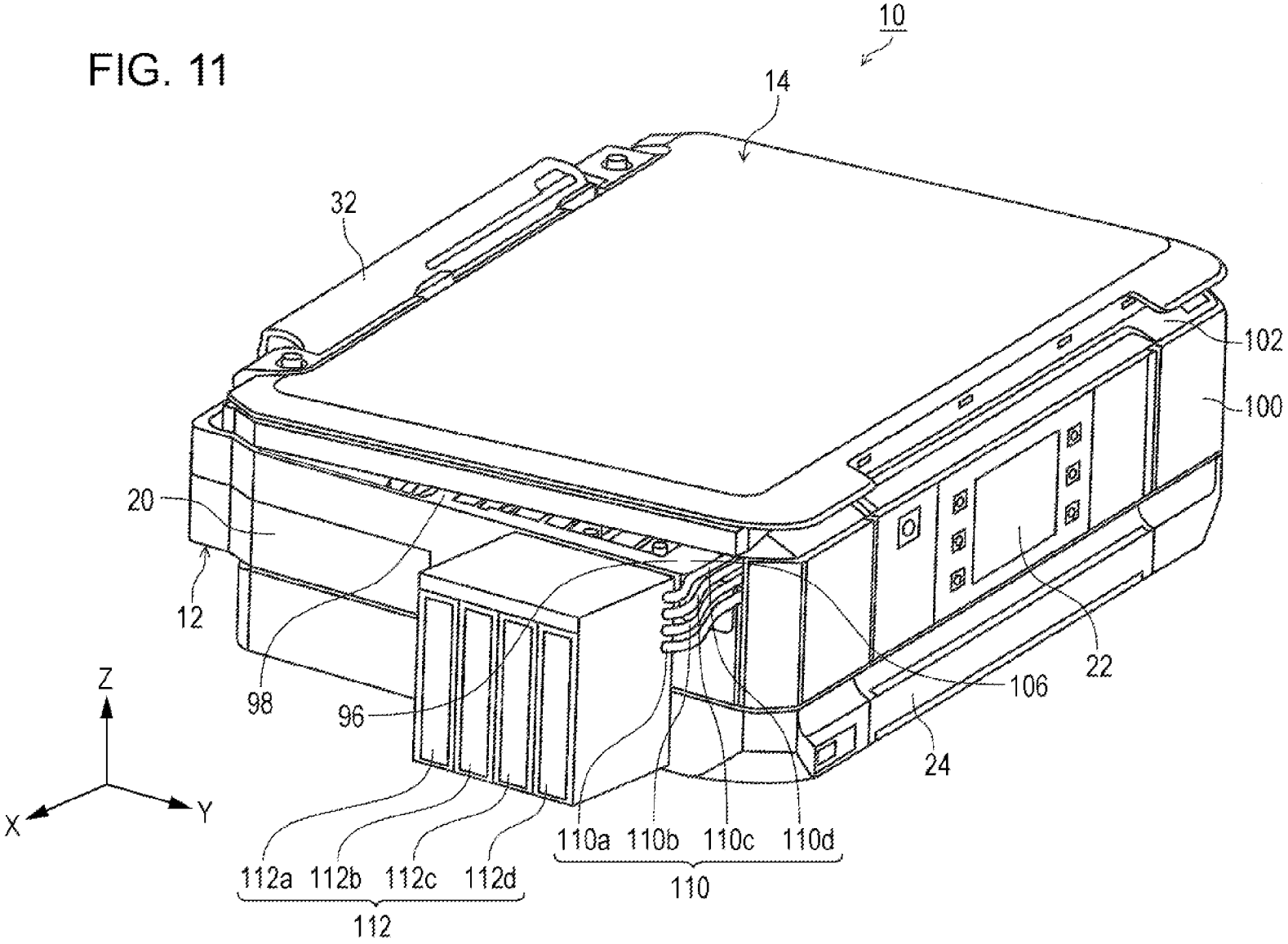
FIG. 11 is an external perspective view illustrating a state in which the scanner unit is closed according to the first example.
Figure 12:
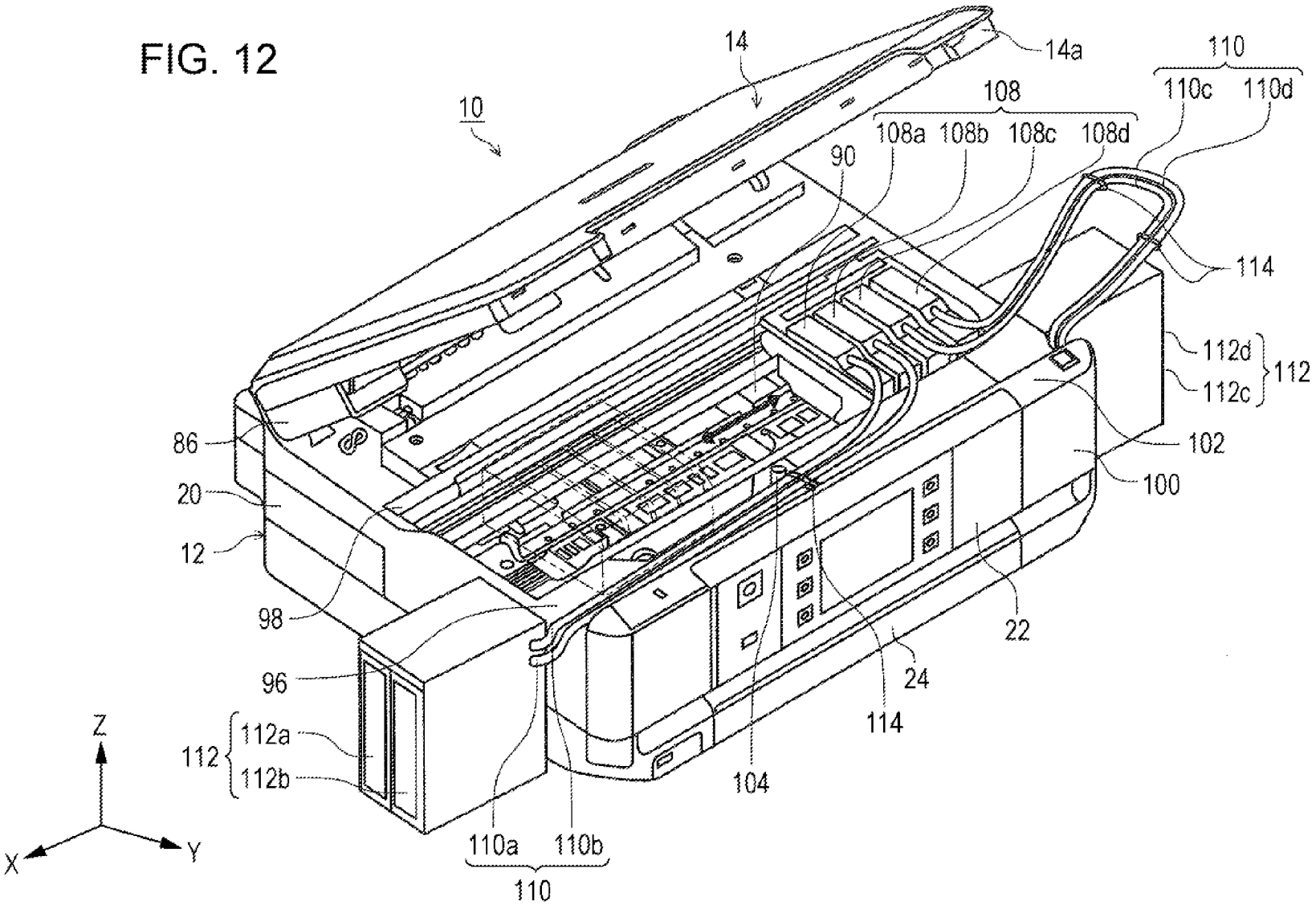
FIG. 12 is an external perspective view illustrating a state in which a scanner unit is opened according to a variation on the first example.
Figure 13:
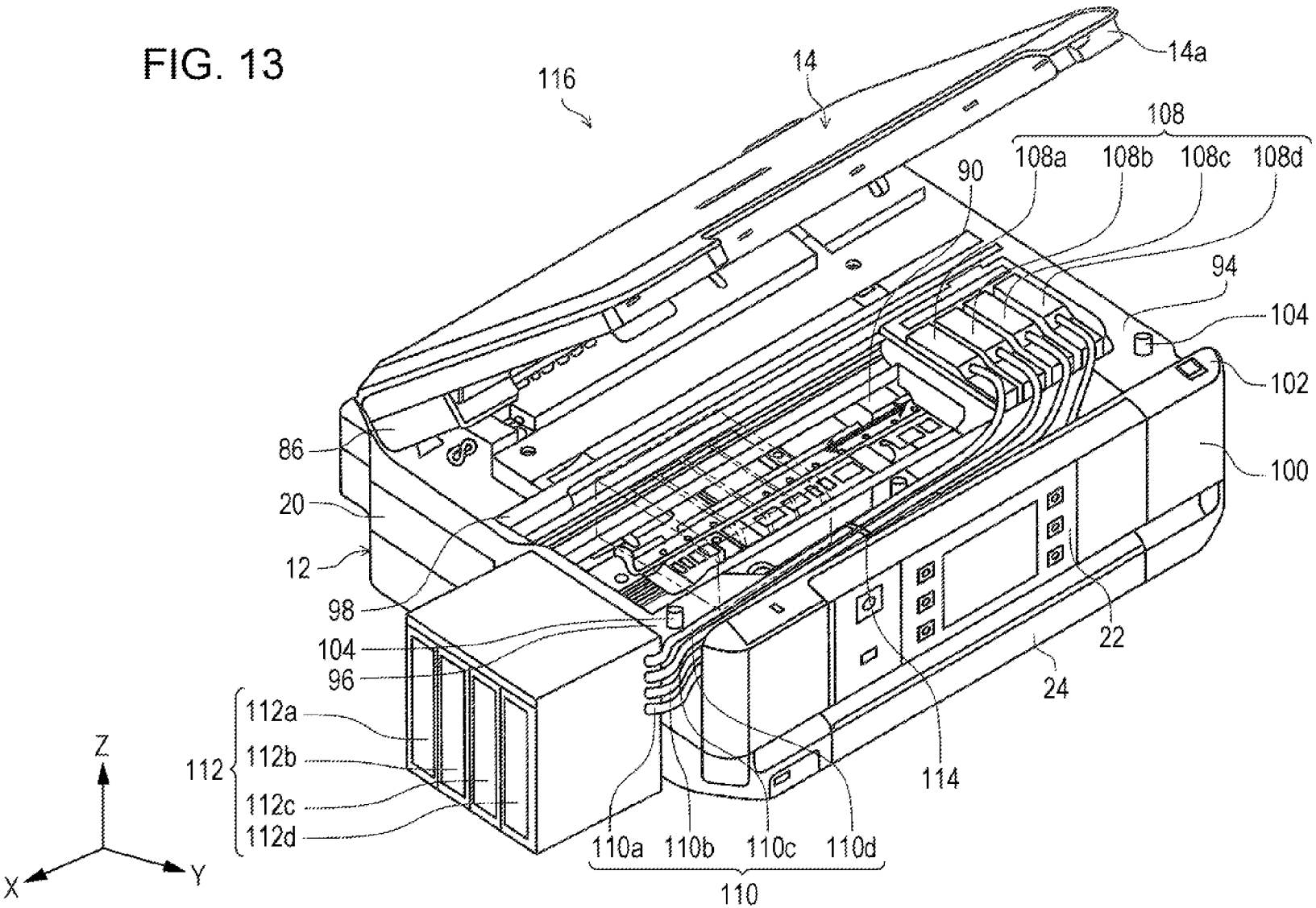
FIG. 13 is an external perspective view illustrating a state in which a scanner unit is opened according to a second example.
Figure 14:
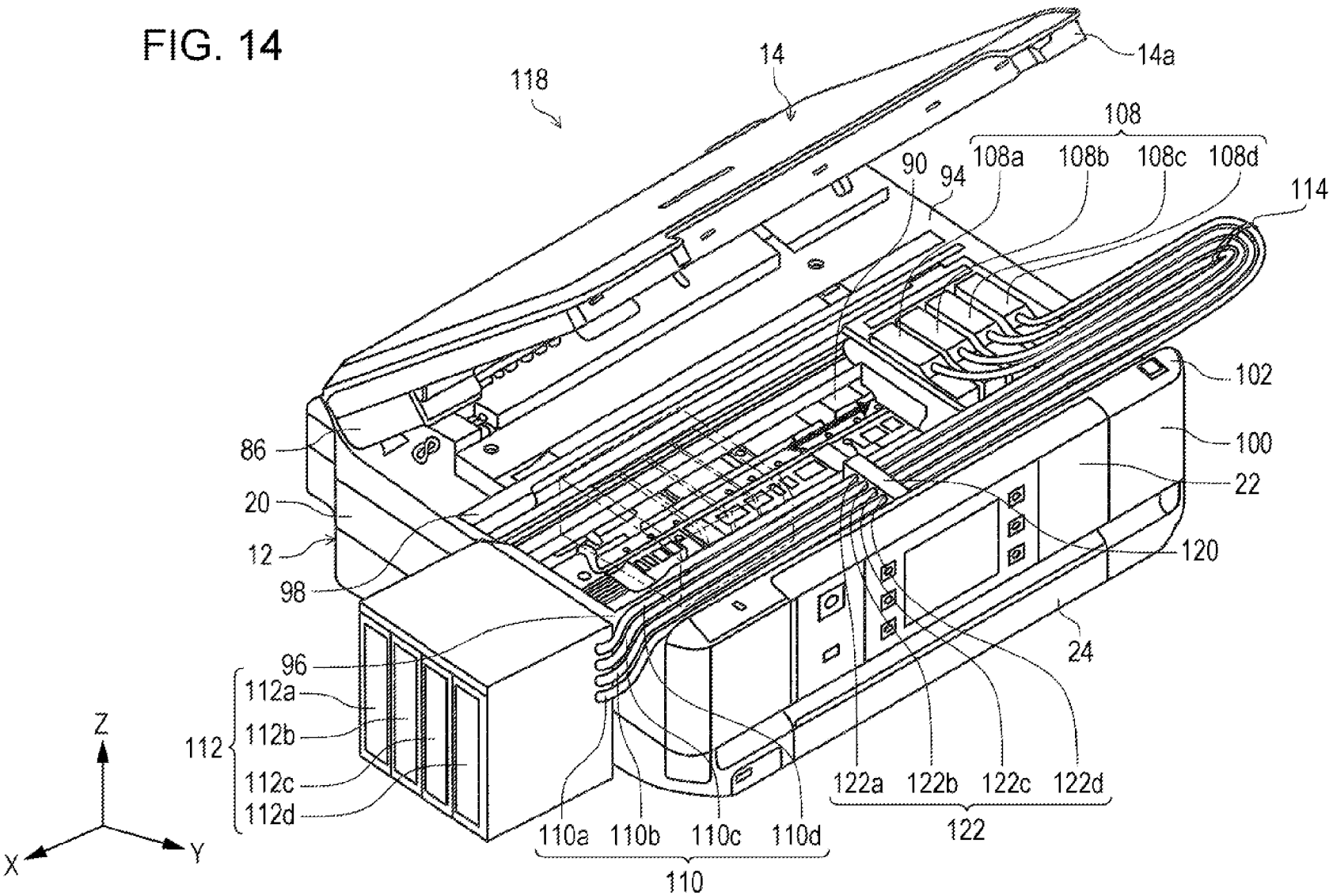
FIG. 14 is an external perspective view illustrating a state in which a scanner unit is opened according to a third example.
Figure 15:
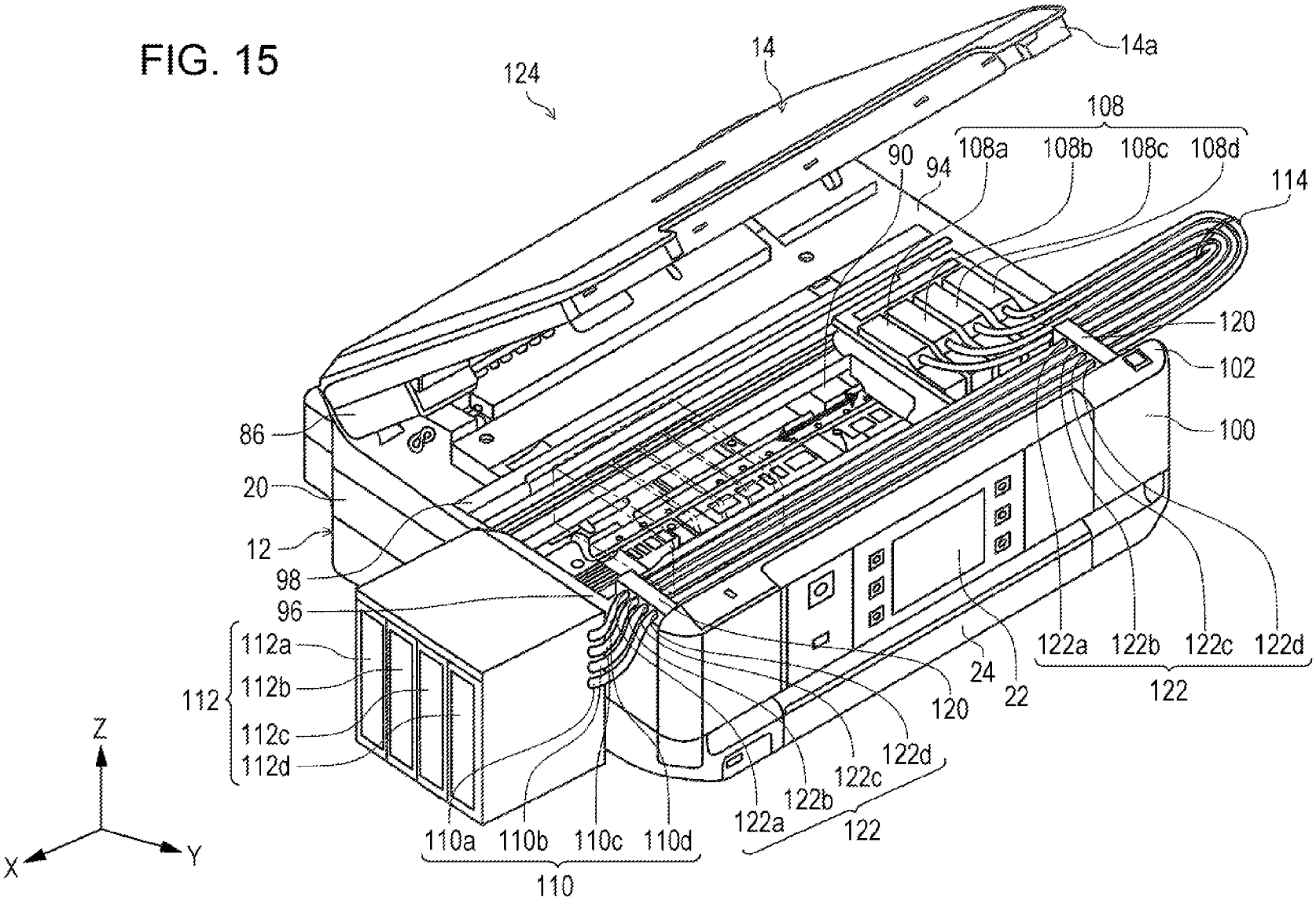
FIG. 15 is an external perspective view illustrating a state in which a scanner unit is opened according to a fourth example.
Figure 16A:
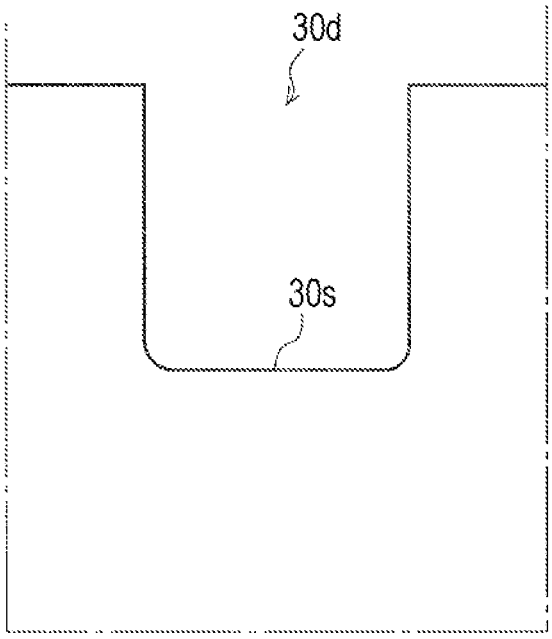
FIGS. 16A and 16B are diagrams schematically illustrating the shapes of relief portions formed in a medium reception tray.
Figure 16B:
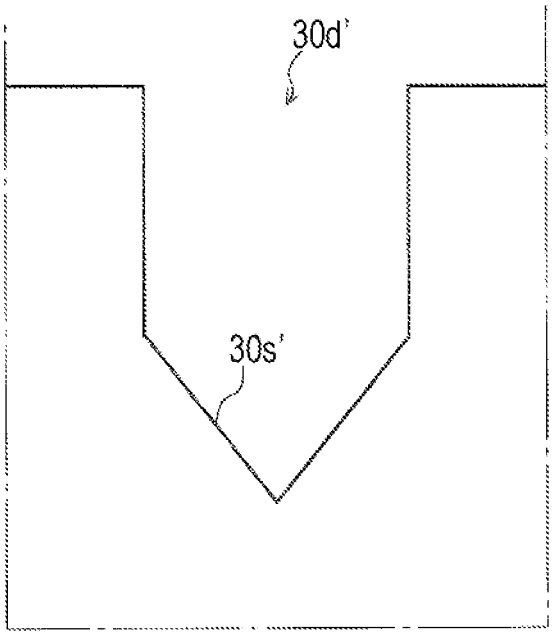

FIG. 11 is an external perspective view illustrating a state in which the scanner unit is closed according to the first example; FIG. 12 is an external perspective view illustrating a state in which a scanner unit is opened according to a variation on the first example; FIG. 13 is an external perspective view illustrating a state in which a scanner unit is opened according to a second example; FIG. 14 is an external perspective view illustrating a state in which a scanner unit is opened according to a third example; and FIG. 15 is an external perspective view illustrating a state in which a scanner unit is opened according to a fourth example. Further, FIGS. 16A and 16B are diagrams schematically illustrating the shapes of relief portions formed in a medium reception tray 30.

The printer 10 according to this embodiment, as will be explained later in detail, includes ink holding units 112, ink tubes 110, and the like, as shown in FIG. 9. However, of these constitutional elements, some are omitted in FIGS. 1 through 3 and the configuration of the printer 10 is illustrated excluding mainly the ink holding units 112, the ink tubes 110, and the like. Moreover, in a state in which a scanner unit 14 is closed to a maximum extent, a space (gap) 106 is formed between a main apparatus body 12 and the scanner unit 14 as shown in FIG. 10 (explained later); however, FIGS. 1 through 3 illustrate the printer 10 as if the space 106 is not formed.

In FIGS. 4 and 5, in order to illustrate rollers that are disposed on the paper transport path in the printer 10, substantially all the rollers are drawn on the same plane. However, the positions in a depth direction thereof (front-back surface direction of the paper of FIGS. 4 and 5) are not necessarily coincident with each other (may be coincident in some case). Moreover, in an X-Y-Z coordinate system indicated in FIG. 4, the X direction indicates a scanning direction of a recording head, the Y direction indicates a depth direction of the recording apparatus, and the Z direction indicates a height direction of the apparatus. Note that in the drawings, the +Y direction side refers to the apparatus front surface side while the −Y direction side refers to the apparatus rear surface side.

1. General Configuration of Printer

Hereinafter, a general configuration of the printer 10 will be described with reference to FIGS. 1 through 5. The printer 10 includes the scanner unit 14 (see FIGS. 4 and 5) as an "opening/closing member" above the main apparatus body 12 as a "recording unit" that performs ink jet recording on recording paper as an example of a medium, that is, the printer 10 is configured as a complex machine having a scanning function in addition to an ink jet recording function.

The scanner unit 14 is provided in a rotatable manner with respect to the main apparatus body 12, and can take a closed state (FIG. 1) or an opened state (FIG. 9) by being rotated. A cover 16 provided on the scanner unit 14 is an openable/closable cover, and opening the cover 16 causes a document platform 18 of the scanner unit 14 (see FIGS. 4 and 5) to appear. Further, the main apparatus body 12 is covered with a housing 20 in which an opening portion 90 is formed. The opening portion 90 exposes at least part of the upper side of a movement region of a head unit, or a carriage 66, which will be explained later.

On the front surface of the main apparatus body 12, there is provided an operation panel 22 including a power button, operation buttons for various print settings and recording execution, a display unit, and the like. The display unit gives a preview display of the contents of print settings and a print image, and the like. The operation panel 22 is so structured as to be tilted; FIG. 1 indicates a state of the panel being completely closed, FIG. 2 indicates a state of the panel being fully opened, and FIG. 3 indicates a state of the panel being halfway opened. As shown in FIGS. 1 through 3, the operation panel 22 can be adjusted to an angle at which a user can operate the panel with ease. Note that an open angle of the operation panel 22 is held by an angle holding mechanism (not shown); even if an external force is applied to the operation panel 22 in a direction toward which the panel is closed due to button pressing operation, the above open angle can be held.

On the apparatus front surface, there is provided a cover 24 under the operation panel 22. The cover 24 is an openable/closable cover provided on a lower stage tray 26; FIG. 1 indicates a state of the cover 24 being closed, while FIGS. 2 and 3 indicate a state of the cover 24 being opened. Opening the cover 24 makes it possible to expose the lower stage tray 26, an upper stage tray 28, and the medium reception tray 30, whereby attaching/detaching the lower stage tray 26 and the upper stage tray 28, sliding the medium reception tray 30, and so on can be performed.

The medium reception tray 30 is so provided as to be displaced by a motor (not shown) in a slidable manner between an accommodation position at which the tray is accommodated in the main apparatus body 12 (see FIG. 1) and a projecting position projected frontward from the main recording body 12 (see FIGS. 3, 4 and 5). By taking the projecting position projected frontward from the main apparatus body 12, the medium reception tray 30 can receive recording paper that has been recorded to be discharged. Although the medium reception tray 30 of this embodiment is moved to be displaced by driving force of a motor (automatic open type), the tray may be so configured as to be moved to be displaced by operation of a user (manual open type).

The lower stage tray 26 and the upper stage tray 28 provided above the lower stage tray 26, which constitute a medium holding unit, are each capable of holding a plurality of sheets of recording paper and are detachable with respect to the main apparatus body 12.

An openable/closable manual paper feed cover 32 is provided at an upper rear portion of the main apparatus body 12. Opening this manual paper feed cover 32 makes it possible to manually feed paper by making use of a manual paper feed tray 34 (see FIGS. 4 and 5).

Next, the paper transport path in the printer 10 will be described with reference to FIGS. 4 and 5. The printer 10 according to this embodiment includes the lower stage tray 26 and the upper stage tray 28 on the apparatus bottom, and feeds out recording paper one by one from the lower stage tray 26 or the upper stage tray 28.

The upper stage tray 28 is so provided as to be displaced in a slidable manner between a feedable position (FIG. 5) and a retreat position (FIG. 4), and is so configured as to be displaced by a motor (not shown) between the feedable position (FIG. 5) and the retreat position (FIG. 4).

In FIGS. 4 and 5, a symbol P1 denotes paper that is held in the lower stage tray 26, while a symbol P2 denotes paper that is held in the upper stage tray 28 (hereinafter, these two kinds of paper are called "paper P" unless they need be specifically distinguished). A passing trajectory of paper P1 fed out from the lower stage tray 26 is indicated by a broken line T1 (see FIG. 4), while a passing trajectory of paper P2 fed out from the upper stage tray 28 is indicated by a broken line T2 (see FIG. 5).

A feed roller (also called a pickup roller) 36 rotationally driven by a motor (not shown) is provided in a swing member 40 that swings about a rotational shaft 38; in a state in which the upper stage tray 28 has been slid to the apparatus front side to the maximum (right direction in FIGS. 4 and 5: extracting direction side of the upper stage tray 28), that is, the upper stage tray 28 is at the retreat position (a state of FIG. 4), the feed roller 36 makes contact with the uppermost sheet of paper P1 held in the lower stage tray 26 and rotates to feed out the uppermost sheet of paper P1 from the lower stage tray 26.

Further, in the case where the upper stage tray 28 has been slid to the apparatus rear side to the maximum (left direction in FIGS. 4 and 5: a mounting direction side of the upper stage tray 28 and also a paper feed-out direction side) so as to be at an abutting position, that is, the upper stage tray 28 is at the feedable position (a state of FIG. 5), the feed roller 36 makes contact with the uppermost sheet of paper P2 held in the upper stage tray 28 and rotates to feed out the uppermost sheet of paper P2 from the upper stage tray 28.

In this embodiment, as shown in FIG. 6, the rotational shaft 38 constitutes a swing shaft of the swing member 40, and transmits power to the feed roller 36 via a gear train 44 from a transmission gear 42 provided on the rotational shaft 38, as shown in FIG. 6, by being rotated upon receiving power from a motor (not shown). Further in this embodiment, the swing member 40 and the feed roller 36 constitute a feeding unit 46 (FIG. 6) that feeds paper P.

In this embodiment, the single feed roller 36 can access both the lower stage tray 26 and the upper stage tray 28. Moreover, even in the case where any one of the lower stage tray 26 and the upper stage tray 28 has been detached from the main apparatus body 12, the feed roller 36 can access the other tray and feed out paper therefrom.

In the main apparatus body 12, a separation slope 48 is provided at a position opposed to leading ends of the lower stage tray 26 and the upper stage tray 28; in a state in which the lower stage tray 26 is mounted, a stopper (not shown) provided on the leading end of the lower stage tray 26 is led to the depth side (left side in FIGS. 4 and 5) further than the separation slope 48 so that the leading end of paper held in the lower stage tray 26 can make contact with the separation slope 48.

With regard to the upper stage tray 28, in a state in which the upper stage tray 28 is located at the feedable position (abutting position: FIG. 5), a stopper 50 provided on the leading end of the upper stage tray 28 is led to the depth side further than the separation slope 48 so that the leading end of paper held in the upper stage tray 28 can make contact with the separation slope 48.

Subsequently, paper P to be fed out from the lower stage tray 26 or the upper stage tray 28 is made to advance toward the downstream side while making contact with the separation slope 48 so that the uppermost sheet of paper P to be fed out is separated from the rest of the paper P.

Ahead of the separation slope 48, there is provided an intermediate roller 52 that is rotationally driven by a motor (not shown); paper P is curved and reversed by the intermediate roller 52 and made to advance toward the apparatus front side. On the circumference of the intermediate roller 52, there are provided slave rollers 54, 56 and 58 that can be rotationally driven with respect to the intermediate roller 52 along a paper transport path. Paper P, when fed into the feed path, is pinched between the intermediate roller 52 and the slave rollers 54, 56 and 58 sequentially along the paper transport path and sent toward the downstream side of the feed path.

Ahead of the intermediate roller 52, there are provided a transport driving roller 60 that is rotationally driven by a motor (not shown) and a transport slave roller 62 that is rotationally driven through making contact with the transport driving roller 60. The paper P is sent by these rollers to a position under a recording head 64.

The recording head 64 which ejects ink is provided on the bottom of the carriage 66, and the carriage 66 is driven by a motor (not shown) so as to move back and forth in a main scanning direction (front-back surface direction of the paper of FIGS. 4 and 5). In addition, at least part of the upper side of a movement region of the carriage 66 is exposed through the opening portion 90 that is formed in the housing 20 (see FIG. 9). With this, in the case where the scanner unit 14 is opened with respect to the main apparatus body 12, the carriage 66 can be accessed from exterior of the main apparatus body 12, thereby making it possible to attach/detach an ink cartridge (not shown) that is attached to the carriage 66.

A support member, or a platen 68 is provided at a position opposed to the recording head 64, and an interval between paper P and the recording head 64 is defined by the support member 68. On the downstream side of the support member 68, there is provided a discharging unit including a discharge driving roller 70 that is rotationally driven by a motor (not shown) and a discharge slave roller 72 that is rotationally driven through making contact with the discharge driving roller 70. Paper P on which recording has been performed by the recording head 64 is discharged by these rollers toward the medium reception tray 30 described above.

Further, in the case where recording is performed on both surfaces of paper P in the printer 10, recording is performed first on a first surface of the paper P by the recording head 64, thereafter the paper P is sent back to the upstream side of the transport driving roller 60 by reverse feed operation of the transport driving roller 60 and the discharge driving roller 70. In the reverse feed operation, a side of the paper P which was the trailing end when recording was performed on the first surface is made to be the leading end. Furthermore, the paper P is sent to a reverse path 69 by the reverse feed operation of the transport driving roller 60. The paper P having been sent into the reverse path 69 is pinched between the intermediate roller 52 and a reverse roller 71 so as to be returned to the paper transport path again.

The paper P having been returned to the feed path is sent again toward the transport driving roller 60 disposed on the downstream side of the paper transport path by the intermediate roller 52 via the slave rollers 54, 56 and 58. In this case, the first surface and a second surface of the paper P are curved and reversed so that the second surface is opposed to the recording head 64. The paper P is sent by the transport driving roller 60 to a position where the paper P is opposed to the recording head 64. The paper P, on the second surface of which recording has been performed by the recording head 64, is discharged by the discharge driving roller 70 to the medium reception tray 30 disposed at the apparatus front side.

2. Configuration of Scanner Unit

Next, a configuration of the scanner unit 14 will be described. The scanner unit 14 is connected with the main apparatus body 12 in a rotatable manner via a rotational shaft 74 (FIGS. 4 and 5), and opens/closes the upper side of the main apparatus body 12 through the rotation. In a state in which the scanner unit 14 is opened, the interior of the main apparatus body 12 can be accessed, thereby making it possible to exchange an ink cartridge (not shown) mounted on the carriage 66, to remove a paper jam, and so on.

The scanner unit 14 is provided with a reading unit 76 that scans along the X direction which is the same as the scanning direction of the recording head 64. The reading unit 76 includes an image sensor such as a contact image sensor (CIS), a charge coupled device (CCD), or the like.

The reading unit 76 is formed in a shape elongating in the Y direction, that is, in the apparatus depth direction, and receives power from a driving source (not shown) to move in the X direction while being guided by a guide rail 78 as a "guide unit" extended in the X direction. A guided unit 80 so structured as to make sliding contact with the guide rail 78 is provided under the reading unit 76. A slave roller 82 that is rotationally driven through making contact with an inner bottom surface of the scanner unit 14 is provided in the reading unit 76. The orientation of the reading unit 76 is maintained to be parallel to the document platform 18 by the guided unit 80 and the slave roller 82.

On a bottom surface 84 of the scanner unit 14, a projection 86 extended in the X direction is provided so as to stick out from the bottom surface 84 toward the main apparatus body 12 side. The projection 86 is a projection used for disposing the guide rail 78, and its occupation region in the apparatus depth direction (Y direction) is defined by a sloped surface 86*a* facing to a movement region of the carriage 66 and a vertical surface 86*b* facing to a double-surface unit 88.

In the configuration of the printer 10 described thus far, a symbol A1 in FIGS. 4 and 5 indicates an occupation region of the carriage 66 in the unit depth direction (Y direction), a symbol A2 indicates the occupation region of the projection 86, and a symbol A3 indicates an occupation region of the intermediate roller 52.

In the printer 10 according to this embodiment, as illustrated in the drawings, a free end side 14*a* of the scanner unit 14, the carriage 66 disposed within the opening portion 90, the projection 86, and the rotational shaft 74 of the scanner unit 14 are disposed in that order in the apparatus depth direction from the apparatus front side (right side in FIGS. 4 and 5) toward the depth side (left side in FIGS. 4 and 5); the projection 86 is disposed at a position on the rotational shaft 74 side in the apparatus depth direction relative to a central position of the scanner unit 14 (position Yc (y1=y2) in FIGS. 4 and 5).

In other words, because the projection 86 of the scanner unit 14 and the carriage 66 are disposed being shifted in position from each other in the apparatus depth direction, the projection 86 and the carriage 66 need not be superposed on each other in the arrangement thereof. This makes it possible to overlap the carriage 66 and the projection 86 with respect to the height direction (Z direction). Therefore, according to this embodiment, it is possible to lower the height of the apparatus in comparison with the configuration in which the projection 86 and the carriage 66 are disposed being superposed on each other.

3. Details of Medium Reception Tray 30

Next, details of the medium reception tray 30 will be further described with reference to FIGS. 6 through 8. In this embodiment, an entire area of a paper reception surface 30*a* of the medium reception tray 30 for receiving paper is formed with a single member, in other words, the medium reception tray 30 is configured not as a multi-stage type tray (drawer type) but as a single-stage type tray. To be more specific, in this embodiment, the whole medium reception tray 30 is integrally formed as one unit with a resin material, whereby rigidity of the medium reception tray 30 is enhanced as a whole and costs are lowered due to the structure of the tray being simplified.

Edge portions (edge portions in a direction intersecting with a paper discharge direction (in a paper width direction, or the scanning direction)) 30*b* of the medium reception tray 30 are supported in a slidable manner with respect to a frame 92 (FIG. 8) constituting a base section of the main apparatus body 12. Racks 30*c* are formed along the paper discharge direction at both end portions of the medium reception tray 30 (both end portions in the direction intersecting with the paper discharge direction). The racks 30*c* are racks that constitute a rack and pinion mechanism and engage with pinions (not shown). When the pinions are rotated with power of a motor (not shown), the medium reception tray 30 is moved in a sliding manner. In this embodiment, although the racks 30*c* are formed at both the end portions, the rack 30*c* may be formed at any one of both the end portions.

A relief portion 30*d* for avoiding the feeding unit 46 is formed at the upstream side in the paper discharge direction of the medium reception tray 30 (left side in FIGS. 4 and 5, upper left side in FIGS. 6 through 8). A width (width in the paper width direction) h of the relief portion 30*d* is set slightly larger than the width of the swing member 40; in other words, the relief portion 30*d* is formed in a cutout shape so as to surround the feeding unit 46 in the case where the medium reception tray 30 is at the accommodation position (a state of FIG. 6), and is set so that the swing member 40 can swing inside the relief portion 30*d*. In addition, in this embodiment, since the feed reference position in the paper width direction is set at the center of paper P, the relief portion 30*d* is formed approximately at the center in the paper width direction.

Action effects of the relief portion 30*d* can be obtained as follows. That is, the medium reception tray 30 is so provided as to be accommodated in the interior of the main apparatus body 12; however, if the feeding unit 46 and the medium reception tray 30 are so provided as to be superposed on each other when the medium reception tray 30 is accommodated in the main apparatus body, the apparatus is likely to become large in size (particularly, the dimension in the height direction increases).

However, as described earlier, because the relief portion 30*d* for avoiding the feeding unit 46 is formed in the medium reception tray 30, it is unnecessary to superpose the feeding unit 46 and the medium reception tray 30 on each other in the apparatus height direction, and it is possible to overlap the feeding unit 46 and the medium reception tray 30 with respect to the height direction. This in turn suppresses the increase in dimension in the apparatus height direction.

Raised areas 30*e* onto which both end portions of paper P advance are formed at the downstream side of the paper reception surface 30*a* of the medium reception tray 30; when both the end portions of paper P (both end portions in a direction intersecting with the paper discharge direction (i.e., paper width direction)) advance onto the raised areas 30*e*, a curl is formed in the paper P. FIG. 7 illustrates a state in which such curl is formed in the paper that is indicated by a symbol P' and a virtual line; the curl is formed in the paper P' in the case where both the end portions on the downstream side thereof have advanced onto the raised areas 30*e* and further the central portion on the upstream side thereof has come slightly into the relief portion 30*d*.

Through this, it can be prevented from occurring that the leading end of the paper P' sticks out from the paper reception surface 30*a*, hangs down, and consequently drops therefrom. In order to form a curl in the paper P' as shown in FIG. 7, it is preferable for the relief portion 30*d* to be formed at the central portion in the paper width direction. However, even in the case where the relief portion 30*d* is formed at an end portion in the paper width direction, it is possible to cause a curl to be formed in the paper P' if the raised areas 30*e* are formed on both the end portions at the downstream side.

In this embodiment, the relief portion 30*d* is formed so that a bottom 30*s* is even in a plan view, as shown in FIG. 16A. However, like a bottom 30*s*' of a relief portion 30*d*' illustrated in FIG. 16B, the relief portion may be formed so that the width thereof becomes narrower toward the downstream side in the discharge direction (downward direction in FIG. 16B), that is, may be formed in a V shape or a U shape, for example.

Further, in the medium reception tray 30, a slope 30*f* is formed at the downstream side of the paper reception surface 30*a* for receiving paper P, that is, the medium reception tray 30 is structured so that paper P to be supported is upwardly inclined. With this, the paper P having been discharged is also unlikely to drop downward.

FIRST EXAMPLE

A first example of the printer 10 will be described with reference to FIGS. 9 through 11. FIG. 9 illustrates a state in which the scanner unit 14 is opened with respect to the main apparatus body 12. The main apparatus body 12 is covered with the housing 20 that constitutes the exterior appearance of the main apparatus body, and the opening portion 90 is provided in an upper surface 94 of the housing 20. The opening portion 90 exposes at least part of the upper side of the movement region of the carriage 66.

In the upper surface 94 of the housing 20, while sandwiching the opening portion 90 in the apparatus depth direction, a front edge portion 96 is formed on the apparatus front side of the opening portion 90 and a rear edge portion 98 is formed on the apparatus rear side of the opening portion 90. A front surface panel 100 including the operation panel 22 is provided on the apparatus front side of the front edge portion 96. A top portion 102 of the front surface panel 100 is so structured as to be higher in position in the apparatus height direction than the front edge portion 96 (see FIG. 10). The rear edge portion 98 is formed between the carriage 66 and the projection 86 of the scanner unit 14 in the apparatus depth direction.

In this example, a gap formation member 104 is provided at a central portion of the front edge portion 96 in the scanning direction; further, the gap formation member 104 sticks out upward from the upper surface 94 of the housing 20. In other words, the gap formation member 104 is positioned on the free end side 14*a* of the scanner unit 14 in the apparatus depth direction.

The gap formation member 104 engages with the free end side 14*a* of the scanner unit 14 and makes the scanner unit 14 ajar with respect to the main apparatus body 12 when the scanner unit 14 is closed against the main apparatus body 12. With this, on the front edge portion 96, the space 106 is formed as a "gap" between the front surface panel 100 and the gap formation member 104 in the apparatus depth direction and also between the front edge portion 96 of the housing 20 and the free end side 14*a* of the scanner unit 14 in the apparatus height direction.

The height of the space 106 in the apparatus height direction is defined by the height of the gap formation member 104 in the apparatus height direction. The space 106 is formed to be sufficiently large in size so that the ink tubes 110, which will be explained later, can be passed therethrough and at least ink flow paths (not shown) in the ink tubes 110 are not blocked. Accordingly, the above-mentioned height of the gap formation member 104 is set so that at least the ink tubes 110 are not crushed by the free end side 14*a* of the scanner unit 14.

At least one ink relay unit 108 is attached to the carriage 66 disposed in the opening portion 90. In this example, a plurality of ink relay units 108*a*, 108*b*, 108*c* and 108*d* are attached to the carriage 66. The ink relay units 108 are so configured as to communicate with the recording head 64 disposed on the lower portion of the carriage 66 and send ink from the ink relay units 108 to the recording head 64.

The flexible ink tubes 110 are connected with the ink relay units 108. Ink tubes 110*a*, 110*b*, 110*c* and 110*d* which are respectively connected with the ink relay units 108*a*, 108*b*, 108*c* and 108*d*, are routed to be arranged within the main apparatus body 12, arranged and fixed in a horizontal direction on the front edge portion 96 in the upper surface 94 of the housing 20 (see FIG. 10), and extended to the outside of the housing 20 passing through the space 106.

In other words, the ink tubes 110 are located on the free end side 14*a* of the scanner unit 14 in the apparatus depth direction. Here, if the ink tubes 110 are disposed on the rotational shaft 74 side of the scanner unit 14, the free end side 14*a* of the scanner unit 14 need be largely opened with respect to the main apparatus body 12 in order to extend the ink tubes 110 to the outside of the housing 20 without the ink flow paths of the ink tubes 110 being blocked. This increases the amount of displacement in the height direction of the scanner unit 14 and consequently increases the height of the printer 10.

On the other hand, when the ink tubes 110 are disposed on the free end side 14*a* of the scanner unit 14 like in this example, it is unnecessary to largely open the free end side 14*a* of the scanner unit 14 with respect to the main apparatus body 12 in comparison with the case in which the tubes are disposed on the rotational shaft 74 side. This makes it possible to suppress the increase in the amount of displacement in the height direction of the scanner unit 14, that is, possible to suppress the height of the printer 10.

Moreover, the front surface panel 100 also functions as a guidance unit that guides the ink tubes 110 to be extended to the outside of the housing 20 passing through the space 106. It is to be noted that the expression "the ink tubes 110 are arranged in a horizontal direction" does not refer to a state in which the ink tubes 110 are precisely arranged in a horizontal direction; as long as the ink tubes 110 are aligned along the apparatus depth direction, it is acceptable even if the ink tubes 110 are deviated from each other in the apparatus height direction.

The ink holding units 112 are provided outside the housing 20. In this example, the ink holding units 112 are arranged at the left side of the housing 20. The ink tubes 110*a*, 110*b*, 110*c* and 110*d* that are extended to the outside of the housing 20 passing through the space 106, are respectively connected with ink holding unit 112*a*, 112*b*, 112*c* and 112*d*.

Accordingly, the ink tubes 110*a*, 110*b*, 110*c* and 110*d* are configured to send ink from the ink holding units 112*a*, 112*b*, 112*c* and 112*d* to the ink relay units 108*a*, 108*b*, 108*c* and 108*d* so that ink can be smoothly guided to the recording head 64.

Further, the ink tubes 110 are extended from the carriage 66 without intersecting with the projection 86 of the scanner unit 14 in the depth direction of the main apparatus body 12, and connected with the ink holding units 112 which are disposed outside the housing 20. Therefore, it is possible to avoid a positional interference between the projection 86 of the scanner unit 14 and the ink tubes 110. This makes it possible to lower the height of the apparatus as a whole.

SECOND EXAMPLE

A printer 116 according to a second example will be described with reference to FIG. 13. The second example differs from the first example in that a plurality of gap formation members 104 are provided therein.

In the second example, the gap formation members 104 are disposed at both end portions, in the scanning direction, of the front edge portion 96 of the housing 20. Accordingly, the plurality of gap formation members 104 (two gap formation members in this example) are configured to support the free end side 14*a* of the scanner unit 14.

As a result, because both sides in the scanning direction of the scanner unit 14 are supported by the gap formation members 104, it is possible to reduce a risk that the scanner unit 14 is inclined along the scanning direction due to an external force or the like. This makes it possible to reduce a risk that the ink tubes 110 are crushed by the scanner unit 14.

THIRD EXAMPLE

Next, a printer 118 according to a third example will be described with reference to FIG. 14. The third example differs from the first example in that a plurality of through-holes are provided in a gap formation member.

In the third example, a gap formation member 120 is disposed at a central portion of the front edge portion 96 in the scanning direction. At least one through-hole 122 is provided in the gap formation member 120. Four through-holes 122*a*, 122*b*, 122*c* and 122*d* are formed in the gap formation member 120 in this example.

The ink tubes 110*a*, 110*b*, 110*c* and 110*d* which are extended from the ink relay units 108*a*, 108*b*, 108*c* and 108*d*, are respectively inserted through and fixed to the through-holes 122*a*, 122*b*, 122*c* and 122*d*.

Accordingly, when the free end side 14*a* of the scanner unit 14 is engaged with the gap formation member 120, the ink tubes 110*a*, 110*b*, 110*c* and 110*d* are located lower in the apparatus height direction than the free end side 14*a* of the scanner unit 14. As a result, in the printer 118 of this example, a risk that the ink flow paths of the ink tubes 110*a*, 110*b*, 110*c* and 110*d* are blocked by the scanner unit 14 is not present, or such risk is low.

This makes it possible for the ink tubes 110*a*, 110*b*, 110*c* and 110*d* to smoothly guide the ink from the ink holding units 112*a*, 112*b*, 112*c* and 112*d* to the recording head 64.

FOURTH EXAMPLE

A printer 124 according to a fourth example will be described with reference to FIG. 15. The fourth example differs from the third example in that a plurality of gap formation members 120 are provided therein.

In the fourth example, the gap formation members 120 are disposed at both the end portions, in the scanning direction, of the front edge portion 96 of the housing 20. Accordingly, the plurality of gap formation members 120 (two gap formation members in this example) are configured to support the free end side 14*a* of the scanner unit 14. As a result, because both the sides in the scanning direction of the scanner unit 14 are supported by the gap formation members 120, a risk that the scanner unit 14 is inclined along the scanning direction due to an external force or the like can be reduced.

Because the ink tubes 110*a*, 110*b*, 110*c* and 110*d* are inserted through the through-holes 122*a*, 122*b*, 122*c* and 122*d*, in the case where the free end side 14*a* of the scanner unit 14 is engaged with the gap formation members 120, the ink tubes 110*a*, 110*b*, 110*c* and 110*d* are located lower in the apparatus height direction than the free end side 14*a* of the scanner unit 14.

As a result, a risk that the ink flow paths of the ink tubes 110 are blocked by the scanner unit 14 is not present, or such risk can be lowered. This makes it possible for the ink tubes 110*a*, 110*b*, 110*c* and 110*d* to smoothly guide the ink from the ink holding units 112*a*, 112*b*, 112*c* and 112*d* to the recording head 64.

Variations on First Through Fourth Examples

1. The ink tubes 110*a*, 110*b*, 110*c* and 110*d* may be configured to be appropriately bound with a binding member 114 such as a binding band or the like in a region between the ink relay units 108*a*, 108*b*, 108*c* and 108*d* and the ink holding units 112*a*, 112*b*, 112*c* and 112*d*.

2. Instead of the ink tubes 110 being fixed on the front edge portion 96, the ink tubes 110 may be configured to be fixed on the rear edge portion 98, that is, arranged on the rotational shaft 74 side of the scanner unit 14, or maybe configured to be fixed to a surrounding area of the opening portion 90 in the upper surface 94 of the housing 20.

3. Instead of the ink tubes 110*a*, 110*b*, 110*c* and 110*d* being extended from the left side of the housing 20, the ink tubes 110*a*, 110*b*, 110*c* and 110*d* may be configured to be extended from the right side of the housing 20.

4. A configuration as illustrated in FIG. 12 may be employed in which the ink tubes 110*a* and 110*b* are extended from the left side of the housing 20 to be respectively connected with the ink holding units 112*a* and 112*b* disposed at the left side of the housing 20, while the ink tubes 110*c* and 110*d* are respectively connected with the ink holding units 112*c* and 112*d* provided at the right side of the housing 20.

5. In place of the configuration in which the gap formation member 104 is disposed on the front edge portion 96, a configuration in which the gap formation member 104 is disposed on the rear edge portion 98 may be employed.

6. The ink holding units 112*a*, 112*b*, 112*c* and 112*d* may be integrally formed together with the housing 20, may be disposed being spaced from the housing 20, or may be configured such that some of the ink holding units are disposed at the right side of the housing 20 and the remaining ink holding units are disposed at the left side of the housing 20.

7. In the above examples, although the ink relay units 108 are configured of the four ink relay units 108*a*, 108*b*, 108*c* and 108*d*, the number of ink relay units is not limited to four; the ink relay units 108 may be so configured as to correspond to ink colors, and the number thereof may be six, for example.

8. Although an opening/closing member to open/close the upper side of the main apparatus body (recording unit) 12 is the scanner unit 14 in the above embodiment, the invention is not limited thereto; the opening/closing member may be simply a cover, or may be a functional unit having a function other than the scanning function.

9. The plurality of ink holding units (ink tanks) 112 are adopted and described in the embodiment; however, for example, a configuration in which a single ink holding unit corresponding to one ink color such as black is provided and only one ink tube 110 corresponding to the black ink is provided, may be employed.

10. The plurality of ink holding units (ink tanks) 112 may be configured to be disposed inside the main apparatus body 12. Alternatively, a configuration in which only a specific color ink is disposed outside the main apparatus body 12, may be employed.

11. The ink holding units (ink tanks) 112 may be what is called a refill type unit into which ink can be injected, or may be what is called a pack-exchange type unit in which an ink pack that holds ink in a pack (bag) is exchanged.

The following is a summary of the descriptions given above. The printers 10, 116, 118 and 124 of the examples each include: the main apparatus body 12 that has the carriage 66 provided with the recording head 64 for ejecting ink onto paper P in a movable manner in the scanning direction of the recording head 64; and the scanner unit 14 that is provided on the upper side of the main apparatus body 12 and is capable of opening and closing the upper side of the main apparatus body 12. The main apparatus body 12 includes: the flexible ink tubes 110 that guide ink which is sent from the ink holding units 112 for holding the ink to the carriage 66; the gap formation members 104, 120 configured to form between the main apparatus body 12 and the scanner unit 14 the space 106 through which the ink tubes 110 pass and the size of which is sufficiently large so as not to block at least the ink flow paths in the ink tubes 110; the feeding unit 46 configured to feed out paper P from the upper stage tray 28 and the lower stage tray 26 for holding the paper P; and the medium reception tray 30 that is so provided as to be displaced in the depth direction of the main apparatus body 12, that has the relief portion 30*d* formed therein on the upstream side in the medium discharge direction so as to avoid the feeding unit 46, and that receives paper P to be discharged.

The scanner unit 14 includes the projection 86 which sticks out from the bottom surface of the scanner unit 14 and on which the guide rail 78 is disposed to guide the reading unit 76 in the scanning direction; the reading unit 76 is configured to scan along the movement direction of the carriage 66. In the depth direction of the main apparatus body 12, the carriage 66, the projection 86, and the rotational shaft 74 of the scanner unit 14 are disposed in that order from the main apparatus body front side toward the depth side. The ink tubes 110 are connected with both the carriage 66 and the ink holding units 112 without intersecting with the projection 86 in the depth direction of the main apparatus body 12.

The printers 10, 116, 118 and 124 each include the housing 20 having the opening portion 90 to expose at least part of the upper side of the movement region of the carriage 66. The gap formation members 104, 120 are disposed in the upper surface 94 of the housing 20 on the free end side 14*a* of the scanner unit 14 which is located opposite to the rotational shaft 74 side of the scanner unit 14 in the depth direction of the main apparatus body 12. The gap formation members 104, 120 are disposed at the center of the housing 20 or on both sides of the housing 20 in the scanning direction.

The printers 10, 116, 118 and 124 each include the front surface panel 100 which is disposed on the front surface of the housing 20 and whose top portion 102 is higher in position than the upper surface 94 of the housing 20. The ink tubes 110 are extended to a side of the housing 20 while passing through the space between the gap formation members 104, 120 and the front surface panel 100.

The printers 10, 116, 118 and 124 each include a plurality of ink tubes 110. Of the plurality of ink tubes 110, at least one ink tube 110 is extended to the left side of the housing 20 passing through the space between the gap formation members 104, 120 and the front surface panel 100, and the remaining ink tubes 110 are extended to the right side of the housing 20.

At least one through-hole 122 is provided in each of the gap formation members 104, 120 so that the ink tube 110 is inserted through the through-hole 122. Further, the printers 10, 116, 118 and 124 each include the ink holding units 112 with which the ink tubes 110 are connected outside the housing 20.

Although the main apparatus body 12 and the scanner unit 14 according to the invention are applied as an example of a recording apparatus to the ink jet printers in the embodiment, they can also be applied to general liquid ejecting apparatuses aside from the ink jet printers.

Note that the liquid ejecting apparatuses include not only recording apparatuses, such as a printer, a copy machine and a fax machine, that use an ink jet recording head and perform recording on a target recording medium by ejecting ink from the ink jet recording head, but also apparatuses that eject liquid corresponding to the usage of recording in place of ink onto an ejection target medium equivalent to the target recording medium from a liquid ejecting head equivalent to the ink jet recording head, and adhere the ejected liquid to the ejection target medium.

As the liquid ejecting heads, the following can be cited aside from the above-mentioned recording heads: that is, coloring material ejecting heads used in the manufacture of color filters of liquid crystal displays or the like, electrode material (conductive paste) ejecting heads used in the formation of electrodes of organic EL displays, surface emitting displays (FEDs) or the like, bioorganic matter ejecting heads used in the manufacture of biochips, sample ejecting heads serving as precision pipettes, and so on.

It is to be noted that the invention is not limited to the above embodiment and examples, and various kinds of variations can be made without departing from the scope of the invention described in the aspects of the invention. Further, it is needless to say that those variations also fall within the scope of the invention.

The entire disclosure of Japanese Patent Application No. 2012-178518, filed Aug. 10, 2012 is expressly incorporated by reference herein.

What is claimed is:

1. A recording apparatus comprising:

a recording unit that includes a head unit provided with a recording head configured to eject ink onto a medium at a position inside a main apparatus body in a movable manner in a scanning direction of the recording head;

an opening/closing member that is provided on an upper side of the recording unit and is capable of opening and closing the upper side of the recording unit;

a flexible ink tube that guides ink which is sent from an ink holding unit for holding the ink to the head unit;

a gap formation member configured to form a gap between the recording unit and the opening/closing member through which the ink tube passes, and the size of which is sufficiently large so as not to block at least an ink flow path in the ink tube;

a feeding unit configured to feed out a medium from a medium holding unit for holding the medium; and a medium reception tray that is so provided as to be displaced between a projecting position projected from the recording unit and an accommodation position at which the medium reception tray is accommodated in the recording unit, and that receives a medium to be discharged, wherein the medium holding unit includes a medium holding tray that is disposed under the medium reception tray independently of the medium reception tray in a detachable manner with respect to the recording unit, and wherein the medium reception tray has a cutout that is formed on an upstream side in a medium discharge direction so as to avoid the feeding unit, and a portion of the feeding unit is located inside the cutout while the medium reception tray being at the accommodation position, wherein a feed reference position of the feeding unit is set at a center in a width direction of the medium and the cutout is formed at the center in the width direction of the medium, wherein the cutout is formed so that the width of the cutout becomes narrower toward a downstream side in a direction in which the medium is discharged wherein, when the medium reception tray is disposed at the accommodation position, an upstream side edge of the medium reception tray in the medium discharge direction is overlapped with another portion the feeding unit.

2. The recording apparatus according to claim 1, wherein at least part of the ink holding unit is disposed outside the main apparatus body.

3. The recording apparatus according to claim 2, wherein the ink holding unit that is disposed outside the main apparatus body is arranged at a side of the recording unit.

4. A recording apparatus comprising:

a housing that includes an upper surface;

a recording unit that includes a head unit provided with a recording head configured to eject ink onto a medium at a position inside a main apparatus body in a movable manner in a scanning direction of the recording head;

an opening/closing member that is provided on an upper side of the recording unit and is capable of opening and closing the upper side of the recording unit;

flexible ink tubes that guide ink which is sent from an ink holding unit for holding the ink to the head unit;

a gap formation member configured to form a gap between the recording unit and the opening/closing member through which the ink tube passes, and the size of which is sufficiently large so as not to block at least an ink flow path in the ink tube; and an operation panel which is disposed on a front surface of the housing and whose top portion is higher in position than the upper surface of the housing, wherein a portion of the housing extends upward from the upper surface of the housing adjacent a back of the operation panel, wherein the flexible ink tubes are held along the operation panel by the gap formation member, wherein the flexible ink tubes are held along the housing side by side in a height direction, wherein the flexible ink tubes are connected to the ink holding unit side by side in the height direction, and wherein the flexible ink tubes are connected to the head unit side by side in a horizontal direction.

5. The recording apparatus according to claim 4, wherein at least part of the ink holding unit is disposed outside the main apparatus body.

6. The recording apparatus according to claim 5, wherein the ink holding unit that is disposed outside the main apparatus body is arranged at a side of the recording unit.

7. A recording apparatus comprising:

a recording unit that includes a head unit provided with a recording head configured to eject ink onto a medium at a position inside a main apparatus body in a movable manner in a scanning direction of the recording head;

an opening/closing member that is provided on an upper side of the recording unit and is capable of opening and closing the upper side of the recording unit;

a housing that has an opening portion formed in the housing to expose at least part of the upper side of a movement region of the head unit, wherein the housing includes an upper surface;

flexible ink tubes that extend to the outside of the housing while passing through a gap between the opening/closing member and the recording unit, and that guide ink which is sent from an ink holding unit for holding the ink to the head unit;

a fixing member that fixes the flexible ink tube to an upper surface of a surrounding area of the opening portion in the housing; and an operation panel which is disposed on a front surface of the housing and whose top portion is higher in position than the upper surface of the housing, wherein a portion of the housing extends upward from the upper surface of the housing at a back of the operation panel, wherein the flexible ink tubes are held along the operation panel by the fixing member, wherein the flexible ink tubes are held along the housing side by side in a height direction, wherein the flexible ink tubes are connected to the ink holding unit side by side in the height direction, and wherein the flexible ink tubes are connected to the head unit side by side in a horizontal direction.

8. The recording apparatus according to claim 7, wherein at least part of the ink holding unit is disposed outside the main apparatus body.

9. The recording apparatus according to claim 8, wherein the ink holding unit that is disposed outside the main apparatus body is arranged at a side of the recording unit.

* * * * *